US007530668B2

(12) United States Patent
Tomita et al.

(10) Patent No.: US 7,530,668 B2
(45) Date of Patent: May 12, 2009

(54) LIQUID EJECTION HEAD, LIQUID EJECTION APPARATUS, AND METHOD FOR FABRICATING LIQUID EJECTION HEAD

(75) Inventors: Manabu Tomita, Kanagawa (JP); Iwao Ushinohama, Kanagawa (JP); Shinji Kayaba, Tokyo (JP); Takeo Eguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 318 days.

(21) Appl. No.: 11/329,666

(22) Filed: Jan. 11, 2006

(65) Prior Publication Data

US 2006/0152550 A1 Jul. 13, 2006

(30) Foreign Application Priority Data

Jan. 12, 2005 (JP) ..... 2005-004606

(51) Int. Cl.
*B41J 2/14* (2006.01)

(52) U.S. Cl. ..... 347/47

(58) Field of Classification Search ..... 347/45, 347/47

See application file for complete search history.

(56) References Cited

U.S. PATENT DOCUMENTS 6,290,331 B1 9/2001 Agarwal et al.
6,299,288 B1 * 10/2001 Abeywardane et al. ..... 347/47
2004/0174411 A1 9/2004 Sumiya et al.

FOREIGN PATENT DOCUMENTS

| | | |
|---|---|---|
| EP | 1 484 183 | 12/2004 |
| JP | 04-039053 | 2/1992 |
| WO | 87/03364 | 6/1987 |
| WO | 03/093018 | 11/2003 |

OTHER PUBLICATIONS

European Search Report dated May 10, 2006.

* cited by examiner

*Primary Examiner*—An H Do
(74) *Attorney, Agent, or Firm*—Sonnenschein Nath & Rosenthal LLP

(57) ABSTRACT

A liquid ejection head includes a liquid chamber configured to contain liquid to be ejected from a nozzle, a liquid ejection member including the nozzle, and an energy generating element configured to provide energy to the liquid contained in the liquid chamber. The energy generating element ejects the liquid contained in the liquid chamber from the nozzle as a liquid droplet. A depression is formed on a surface of the liquid ejection member around the nozzle such that an opening of the depression has a width greater than a width of an opening of the nozzle and the nozzle is positioned at the bottom of the depression. The interior angle of the bottom corner of the depression is determined to be greater than 90 degrees.

7 Claims, 12 Drawing Sheets

LIQUID EJECTION HEAD, LIQUID EJECTION APPARATUS, AND METHOD FOR FABRICATING LIQUID EJECTION HEAD

CROSS REFERENCES TO RELATED APPLICATIONS

The present invention contains subject matter related to Japanese Patent Application JP 2005-004606 filed in the Japanese Patent Office on Jan. 12, 2005, the entire contents of which are incorporated herein by reference.

BACKGROUND OF THE INVENTION

1. Field of the Invention

The present invention relates to a liquid ejection head that ejects liquid contained in a liquid chamber from a nozzle as liquid droplets, a liquid ejection apparatus, and a method for fabricating the liquid ejection head. In particular, the present invention relates to a technology that improves print quality while maintaining the rigidity of a nozzle sheet including the nozzle.

2. Description of the Related Art

A liquid ejection head that ejects liquid from a nozzle using an energy generating element has become widespread. For example, printer heads of inkjet printers are of this type, in which a pressure is applied to ink contained in an ink chamber using an energy generating element so that the ink is ejected from a nozzle as ink droplets. The ink droplets are deposited on a print paper sheet placed in front of the nozzle so as to form substantially circular dots in vertical and horizontal directions and represent an image or characters.

Under ideal conditions, the ink droplet is ejected from the nozzle of the printer head in a direction perpendicular to a nozzle sheet including the nozzle. However, in practice, the ejection direction of the ink droplet is usually not perpendicular to the nozzle sheet. If the ejection direction is not perpendicular to the nozzle sheet, the position of a deposited ink droplet on a print sheet is offset from the proper position. Thus, white streaking may occur on an image, and therefore, the quality of the image is degraded.

To prevent the occurrence of white streaking, the present inventors proposed a technology that changes the ejection direction of an ink droplet. In that technology, a plurality of heating elements (one type of energy generating elements) capable of being independently driven is arranged in an ink chamber. By independently driving the heating elements, the ejection direction of an ink droplet can be deflected (refer to, for example, Japanese Unexamined Patent Application Publication No. 2004-1364).

FIG. 14 is an exploded perspective view of a known printer head 111 described in Japanese Unexamined Patent Application Publication No. 2004-1364. In the drawing, an exploded nozzle sheet 117, which is bonded to a barrier layer 116, is shown. Also, for the sake of convenience of description, the printer head 111 is shown upside-down relative to the orientation typically used for the real printer head 111.

In the printer head 111, a substrate member 114 includes a semiconductor substrate 115 composed of, for example, silicon, and a heating element 113 formed by deposition on a surface of the semiconductor substrate 115. The heating element 113 includes left and right separated portions.

A barrier layer 116 is formed on the surface of the semiconductor substrate 115 on which the heating element 113 is formed. The barrier layer 116 serves as a member for forming an ink chamber 112. A nozzle sheet 117 serves as a liquid ejection member in which a plurality of nozzles 118 is formed. The nozzle sheet 117 is bonded to the barrier layer 116 so that the nozzles 118 face the heating element 113.

The ink chamber 112 is formed from the substrate member 114, the barrier layer 116, and the nozzle sheet 117 such that the substrate member 114, the barrier layer 116, and the nozzle sheet 117 surround the heating element 113. That is, as shown in FIG. 14, the substrate member 114 and the heating element 113 form a bottom wall of the ink chamber 112, the barrier layer 116 forms side walls of the ink chamber 112, and the nozzle sheet 117 forms a top wall of the ink chamber 112. Thus, the ink chamber 112 includes an opening in the lower right area in FIG. 14, through which ink is provided to the ink chamber 112 from an ink tank (not shown) connected to the printer head 111.

In the printer head 111 having such a structure, by heating the heating element 113, the ink in contact with the heating element 113 generates a bubble. The expansion of the bubble expels a certain volume of the ink. An ink having the same volume as the expelled volume is ejected from the nozzles 118 in the form of an ink droplet. Accordingly, by depositing the ink droplets on a recording paper sheet, an image or characters can be created.

Here, the two portions of the heating element 113 can be independently driven. The two portions are concurrently heated. If the periods of time in which the temperatures of the two portions reach the boiling temperature of ink (i.e., bubble generating time) are the same, the quantities of ink on the two portions boil at the same time. As a result, an ink droplet is ejected in a direction perpendicular to the nozzle sheet 117 (i.e., direction of the central axis of the nozzles 118).

In contrast, if the bubble generating times for the two portions are different, the quantities of ink on the two portions do not boil at the same time. As a result, an ink droplet is ejected in a direction offset from the central axis of the nozzles 118. That is, the ink droplet is ejected while being deflected.

As described above, according to the technology discussed in Japanese Unexamined Patent Application Publication No. 2004-1364, the ejection direction of an ink droplet can be deflected. This deflected ejection can prevent white streaking of a printed image, thereby obtaining the improved print quality.

However, the state of the surface (ejection surface) also has an impact on the print quality. That is, when the ejection of ink is repeated many times, the ink is deposited on the surface of the nozzle sheet 117 around the nozzles 118. The deposited ink has an adverse effect on the ejection direction of an ink droplet. As a result, the ink droplet is not deposited on the desired location of the print paper sheet, thereby degrading the print quality.

Additionally, if the ink deposited on the nozzle sheet 117 becomes solidified, the ink remains adhered to the nozzle sheet 117. If the adhered ink is removed from the nozzle sheet 117 and clogs the nozzle 118, the clogged nozzle causes an ejection defeat, and therefore, the print quality is degraded.

Accordingly, a technology has been proposed in which the nozzle sheet 117 has a hydrophobic area to prevent the deposition of ink (refer to, for example, Japanese Unexamined Patent Application Publication No. 8-39817). According to this technology, the nozzle sheet 117 includes a wiping mechanism to wipe the surface of the nozzle sheet 117, a hydrophobic area on the surface of the nozzle sheet 117 around the nozzles 118, and a hydrophilic area on the surface of the nozzle sheet 117 only downstream in the wiping direction.

According to the technology discussed in Japanese Unexamined Patent Application Publication No. 8-39817, the hydrophobic area provided on the surface of the nozzle sheet 117 can prevent the deposition of ink upstream in the wiping direction. Accordingly, clogging of the nozzles 118 due to the insertion of the adhered ink into the nozzles 118 by the wiping operation can be prevented. As a result, the ejection defect of the nozzles 118 can be prevented, thereby improving the print quality.

Also, a technology is proposed in which a plurality of U-shaped depressions is formed at positions slightly spaced away from the nozzle 118. That is, the surface of the nozzle sheet 117 provides a hydrophilic area, while a plurality of U-shaped depressions whose interiors are hydrophobic areas is formed at predetermined positions with respect to the nozzles 118 (refer to, for example, Japanese Unexamined Patent Application Publication No. 2001-1523).

According to the technology discussed in Japanese Unexamined Patent Application Publication No. 2001-1523, the hydrophilic area prevents the deposition of ink. The ink to be deposited on the nozzle sheet 117 is caught by the U-shaped depressions whose interiors are hydrophobic areas. Accordingly, the ink does not have a negative impact on the ejection direction of an ink droplet. As a result, the ejection defect of the nozzles 118 can be prevented, thereby improving the print quality.

SUMMARY OF THE INVENTION

In the technology discussed in Japanese Unexamined Patent Application Publication No. 2004-1364, to largely deflect the ejection direction of an ink droplet, the thickness of the nozzle sheet 117 needs to be reduced or the diameter of the nozzle 118 needs to be increased. However, if the diameter of the nozzle 118 is increased, the size of an ink droplet is also increased. Consequently, the resolution of a print image is reduced, thereby preventing the improvement of the print quality. Thus, it is desirable to reduce the thickness of the nozzle sheet 117 with respect to the deflection of the ejection direction of an ink droplet.

However, although reducing the thickness of the nozzle sheet 117 provides an advantage as to the deflection of the ejection direction, reducing the thickness reduces the rigidity of the nozzle sheet 117. Accordingly, the nozzle sheet 117 vibrates due to paper feed during print time, and therefore, the vibration may have a negative impact on the ejection direction of an ink droplet. That is, the deflection of the ejection direction and the rigidity of the nozzle sheet 117 are closely related.

Accordingly, the thickness of the nozzle sheet 117 in only an area in the vicinity of the nozzle 118 may be reduced to largely deflect the ejection direction of an ink droplet while maintaining the rigidity of the nozzle sheet 117. That is, in order to prevent the deformation of the nozzle sheet 117 due to ejection pressure of the heating element 113 or the vibration caused by paper feed during print time, the nozzle sheet 117 having a sufficient thickness is employed. Only the area of the nozzle sheet 117 in the vicinity of the nozzle 118 has a thickness corresponding to the length of the nozzles 118, and the other area of the nozzle sheet 117 is reduced in thickness.

However, if the thickness of a partial area of the nozzle sheet 117 is reduced, the partial area becomes a depression that easily attracts ink. The ink deposited to the area of the nozzle sheet 117 having a small thickness cannot be removed even when the technology discussed in Japanese Unexamined Patent Application Publication No. 8-39817 is applied. Also, the ink deposited to the area cannot be completely removed even when Japanese Unexamined Patent Application Publication No. 2001-1523 is applied. That is, the technology discussed in Japanese Unexamined Patent Application Publication No. 8-39817 provides a wiping mechanism that wipes the surface of the nozzle sheet 117. However, this wiping mechanism cannot wipe the area of the nozzle sheet 117 having a small thickness (i.e., depression area).

Additionally, the technology discussed in Japanese Unexamined Patent Application Publication No. 2001-1523 provides a plurality of U-shaped depressions in the vicinity of the nozzle 118. This decreases the print quality. That is, to increase the print quality, a plurality of the nozzles 118 is desired to be arranged at a very high density by reducing the distance between the adjacent nozzles 118. However, to reduce the thickness of the partial areas of the nozzle sheet 117 in the vicinity of the nozzles 118 and to provide U-shaped depressions to the thin areas, a new space for the U-shaped depressions is needed, thus increasing the distance between the adjacent nozzles 118.

Furthermore, if the U-shaped depression is filled with ink, the U-shaped depression cannot receive newly deposited ink, and therefore, the ink overflows from the depression. In particular, during high-speed printing, since many sheets are printed in a short time, a time for evaporation of the deposited ink is very short. Accordingly, the overflow of ink becomes more noticeable. As a result, the technology discussed in Japanese Unexamined Patent Application Publication No. 2001-1523 provides an insufficient effect for preventing the ink deposition.

Accordingly, there is a need for a liquid ejection head and a liquid ejection apparatus that improve print quality while maintaining the rigidity of a nozzle sheet by preventing ink deposition on the nozzle sheet even when the nozzle sheet in the vicinity of a nozzle is reduced in thickness, and a method for fabricating the liquid ejection head.

According to an embodiment of the present invention, a liquid ejection head includes a liquid chamber configured to contain liquid to be ejected from a nozzle, a liquid ejection member including the nozzle, and an energy generating element configured to provide energy to the liquid contained in the liquid chamber. The energy generating element ejects the liquid contained in the liquid chamber from the nozzle as a liquid droplet. In the liquid ejection head, a depression is formed on a surface of the liquid ejection member around the nozzle such that an opening of the depression has a width greater than the width of an opening of the nozzle, and the nozzle is positioned at the bottom of the depression, and the interior angle of the bottom corner of the depression is greater than 90 degrees.

In the liquid ejection head, a depression is formed on a surface of the liquid ejection member around the nozzle such that an opening of the depression has a width greater than the width of an opening of the nozzle, and the nozzle is positioned at the bottom of the depression. Accordingly, the thickness of the nozzle sheet can be reduced only in the vicinity of the nozzle. Additionally, the interior angle of the bottom corner of the depression is greater than 90 degrees. That is, the bottom corner of the depression has a curved surface or a sloped surface. Accordingly, ink is not accumulated at the bottom corner of the depression.

According to another embodiment of the present invention, a liquid ejection apparatus includes a liquid ejection head including a liquid ejection member having a nozzle. The liquid ejection head ejects liquid contained in a liquid chamber from the nozzle as a liquid droplet by means of an energy generating element, and the liquid ejection head ejects and deposits the liquid droplet onto a recording medium so as to print an image on the recording medium. In the liquid ejection head, a depression is formed on a surface of the liquid ejection member of the liquid ejection head around the nozzle such that an opening of the depression has a width greater than a width of an opening of the nozzle, and the nozzle is positioned at the bottom of the depression, and wherein the interior angle of the bottom corner of the depression is greater than 90 degrees. The liquid ejected from the liquid ejection head as the liquid droplet and deposited onto the interior of the depression is returned to the nozzle after the liquid droplet has been ejected.

According to this embodiment, a depression is formed on a surface of the liquid ejection member around the nozzle such that an opening of the depression has a width greater than the width of an opening of the nozzle, and the nozzle is positioned at the bottom of the depression. The interior angle of the bottom corner of the depression is greater than 90 degrees. Additionally, the liquid ejected from the liquid ejection head as the liquid droplet and deposited onto the interior of the depression is returned to the nozzle after the liquid droplet has been ejected. Accordingly, ink is not accumulated in the depression. Thus, an initial clean state can be maintained at all times.

According to another embodiment of the present invention, a method is provided for fabricating a liquid ejection head that includes a liquid chamber configured to contain liquid to be ejected from a nozzle, a liquid ejection member including the nozzle and a depression formed around the nozzle, and an energy generating element configured to provide energy to the liquid contained in the liquid chamber and configured to eject the liquid contained in the liquid chamber from the nozzle as a liquid droplet. In the liquid ejection head, the nozzle is positioned at the bottom of the depression and the interior angle of the bottom corner of the depression is greater than 90 degrees. The method includes the steps of (a) forming a resist pattern corresponding to the depression on a mother mold, (b) forming an electroforming layer on the resist pattern and the mother mold excluding an area corresponding to the nozzle in the resist pattern so as to form the electroforming layer including the nozzle, (c) forming the depression on the electroforming layer by removing the resist pattern, (d) forming the liquid ejection member including the nozzle and the depression by stripping off the electroforming layer from the mother mold, and (e) bonding the liquid ejection member to a substrate on which the energy generating element is disposed with a liquid chamber forming member therebetween.

According to this embodiment, a nozzle can easily be formed in a liquid ejection member and a desired depression can easily be formed on a surface of the liquid ejection member around the nozzle. By bonding the liquid ejection member to a substrate on which the energy generating element is disposed with a liquid chamber forming member therebetween, a liquid ejection head can easily be fabricated in which the nozzle is positioned at the bottom of the depression of a liquid ejection member and the interior angle of the bottom corner of the depression is greater than 90 degrees.

According to still another embodiment of the present invention, a method is provided for fabricating a liquid ejection head that includes a liquid chamber configured to contain liquid to be ejected from a nozzle, a liquid ejection member including the nozzle and a depression formed around the nozzle, and an energy generating element configured to provide energy to the liquid contained in the liquid chamber and configured to eject the liquid contained in the liquid chamber from the nozzle as a liquid droplet. In the liquid ejection head, the nozzle is positioned at the bottom of the depression and the interior angle of the bottom corner of the depression is greater than 90 degrees. The method includes the steps of (a) forming a resist pattern corresponding to the liquid chamber and the nozzle on a substrate on which the energy generating element is disposed, (b) forming a nozzle forming layer on the substrate around the resist pattern, the nozzle forming layer being composed of a photosensitive resin and forming part of the liquid ejection member, (c) forming a depression forming layer on the nozzle forming layer and the resist pattern, the depression forming layer being composed of a photosensitive resin and forming the liquid ejection member integrally with the nozzle forming layer, (d) forming the depression by exposing the depression forming layer to exposure light and developing the depression forming layer, and (e) forming the liquid chamber and the nozzle in the nozzle forming layer by removing the resist pattern.

According to this embodiment, a liquid chamber, a nozzle, and a depression around the nozzle can be formed as an integral part. That is, the liquid chamber, the nozzle, and the depression can directly be formed on a substrate on which an energy generating element is disposed. Accordingly, a liquid ejection head can simply and efficiently be fabricated in which the nozzle is positioned at the bottom of the depression of a liquid ejection member and the interior angle of the bottom corner of the depression is greater than 90 degrees.

According to a liquid ejection head of the above-described embodiments, since a depression is formed on the surface of a liquid ejection member around a nozzle, the thickness of a nozzle sheet can be decreased only around the nozzle. Accordingly, the print image quality can be improved while maintaining the rigidity of the nozzle sheet. In addition, the interior angle of the bottom corner of the depression is greater than 90 degrees. Accordingly, ink is not accumulated in the bottom corner of the depression, thereby efficiently preventing the decrease in the print image quality.

According to a liquid ejection apparatus of the above-described embodiments, a depression is formed on the surface of a liquid ejection member of a liquid ejection head around a nozzle. The nozzle is positioned at the bottom of the depression and the interior angle of the bottom corner of the depression is greater than 90 degrees. In addition, liquid ejected from the liquid ejection head as the liquid droplet and deposited onto the interior of the depression is returned to the nozzle after the liquid droplet has been ejected. Thus, an initial clean state can be maintained at all times, and therefore, a superior print image quality can be maintained.

According to a method for fabricating a liquid ejection head of the above-described embodiments, a liquid ejection head in which the nozzle is positioned at the bottom of a depression of a liquid ejection member and the interior angle of the bottom corner of the depression is greater than 90 degrees can easily be fabricated. Accordingly, a liquid ejection head that improves the print image quality while maintaining the rigidity of a nozzle sheet can easily be fabricated.

DESCRIPTION OF THE PREFERRED EMBODIMENTS

Figure 1:
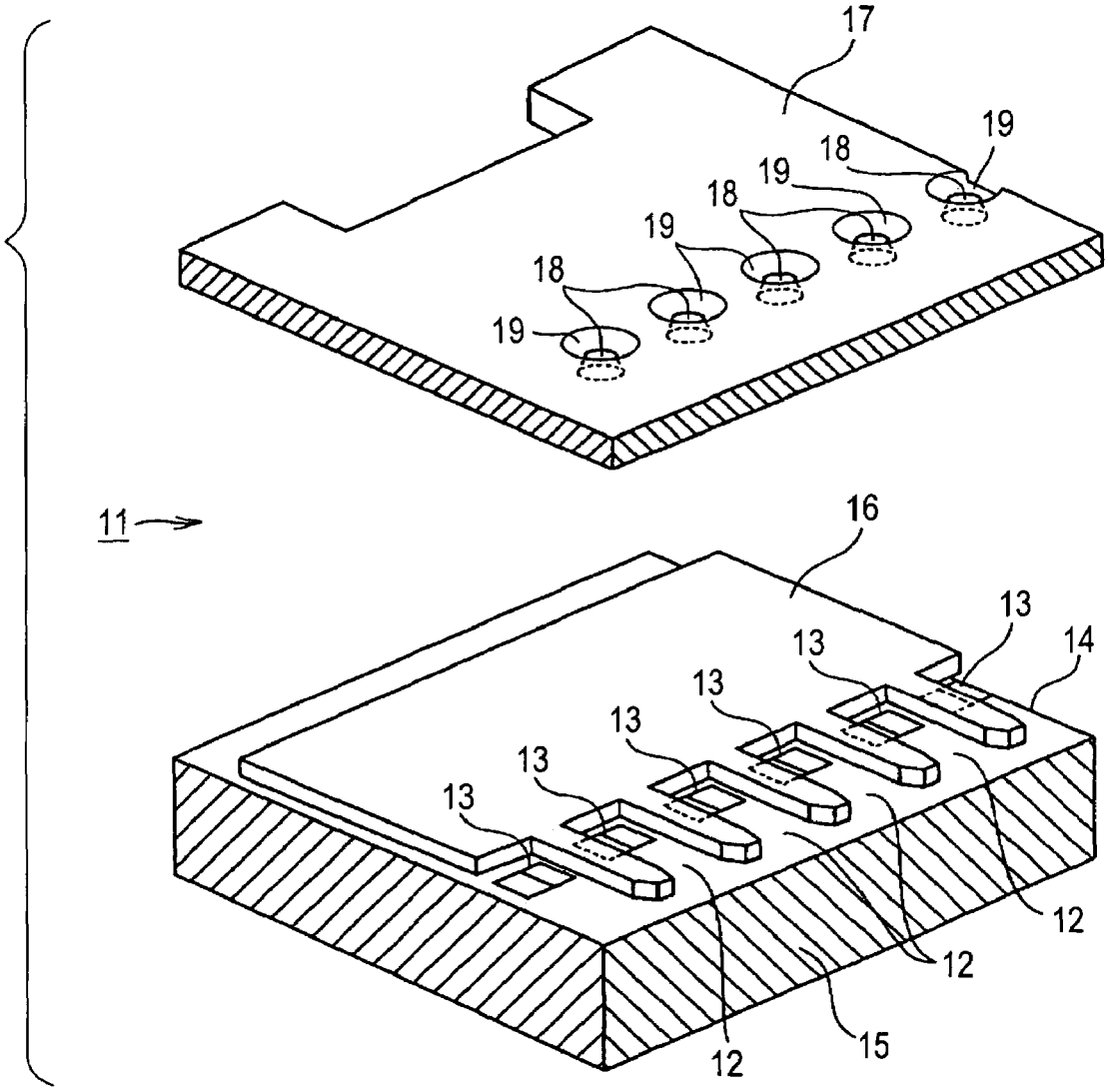
FIG. 1 is an exploded perspective view of a printer head according to a first embodiment of the present invention.

Exemplary embodiments of the present invention are described with reference to the accompanying drawings.

A liquid ejection head according to the following embodiments of the present invention corresponds to a printer head 11 of an inkjet printer. Also, in the following embodiments, the printer head 11 ejects ink liquid. An ink chamber 12 contains the ink. An ink droplet is a small amount (e.g., several picoliters) of the ink ejected from a nozzle 18. Furthermore, in the following embodiments, a heating element 13 is employed as an energy generating element. The heating element 13 is formed on a surface of a semiconductor substrate 15, which is a substrate member 14, by deposition. The heating element 13 becomes part of surface (a bottom wall) of the ink chamber 12. A liquid ejection apparatus according to an embodiment of the present invention is an inkjet printer including the printer head 11.

First Exemplary Embodiment

FIG. 1 is an exploded perspective view of the printer head 11 according to the first embodiment. In FIG. 1, a nozzle sheet 17 to be bonded to a barrier layer 16 is exploded. For the sake of convenience of description, the printer head 11 is shown upside-down relative to the orientation typically used for the real printer head 11.

As shown in FIG. 1, the printer head 11 according to the first embodiment includes the substrate member 14 having the heating element 13, the barrier layer 16 which corresponds to a liquid chamber forming member to form the ink chamber 12, and the nozzle sheet 17 which includes a nozzle 18 and which corresponds to a liquid ejection member. That is, the nozzle sheet 17 is bonded to the substrate member 14 with the barrier layer 16 therebetween.

The substrate member 14 includes the semiconductor substrate 15 and the heating element 13. That is, the heating element 13 is formed on a surface (top surface in FIG. 1) of the semiconductor substrate 15, which is the substrate member 14, by deposition. The heating element 13 includes two portions, each of which has the length longer than the width. Each of the divided two portions of the heating element 13 is electrically connected to an external circuit via a conductor potion formed on the semiconductor substrate 15.

The barrier layer 16 is formed on a surface (top surface in FIG. 1) of the substrate member 14 adjacent to the heating element 13 with a photosensitive resin. The barrier layer 16 separates a plurality of the heating elements 13 and maintains a spacing between each of the heating elements 13 and the nozzle sheet 17. Thus, each of the ink chambers 12 is formed by the substrate member 14, the barrier layer 16, and the nozzle sheet 17. The substrate member 14 and the heating element 13 serve as a top wall of the ink chamber 12. The barrier layer 16 serves as three side walls of the ink chamber 12. The nozzle sheet 17 serves as a bottom wall of the ink chamber 12.

The nozzle sheet 17 is formed from, for example, nickel (Ni). A plurality of the nozzles 18 is formed in the nozzle sheet 17. A depression 19 is formed around each of the nozzles 18. The nozzle sheet 17 is bonded to the barrier layer 16 so that each of the nozzles 18 is precisely positioned at the heating element 13, that is, each of the nozzles 18 faces one of the heating elements 13.

To perform printing using the inkjet printer including the printer head 11, ink contained in an ink tank (not shown) is supplied to each of the ink chambers 12 through an opening area at the lower right of the printer head 11 shown in FIG. 1. Subsequently, a pulse electrical current is applied to the two portions of the heating element 13 in a short time (e.g., 1 to 3 μs) so as to rapidly heat up the heating element 13. A bubble of ink is then generated in an area in contact with the heating element 13. The expansion of the bubble expels a certain volume of ink. As a result, this generates an ejection pressure, which ejects the same volume of ink as that of the expelled ink in the form of an ink droplet. The ink droplet is deposited onto a print paper sheet (not shown) serving as a recording medium and forms a character and an image.

Figure 2:
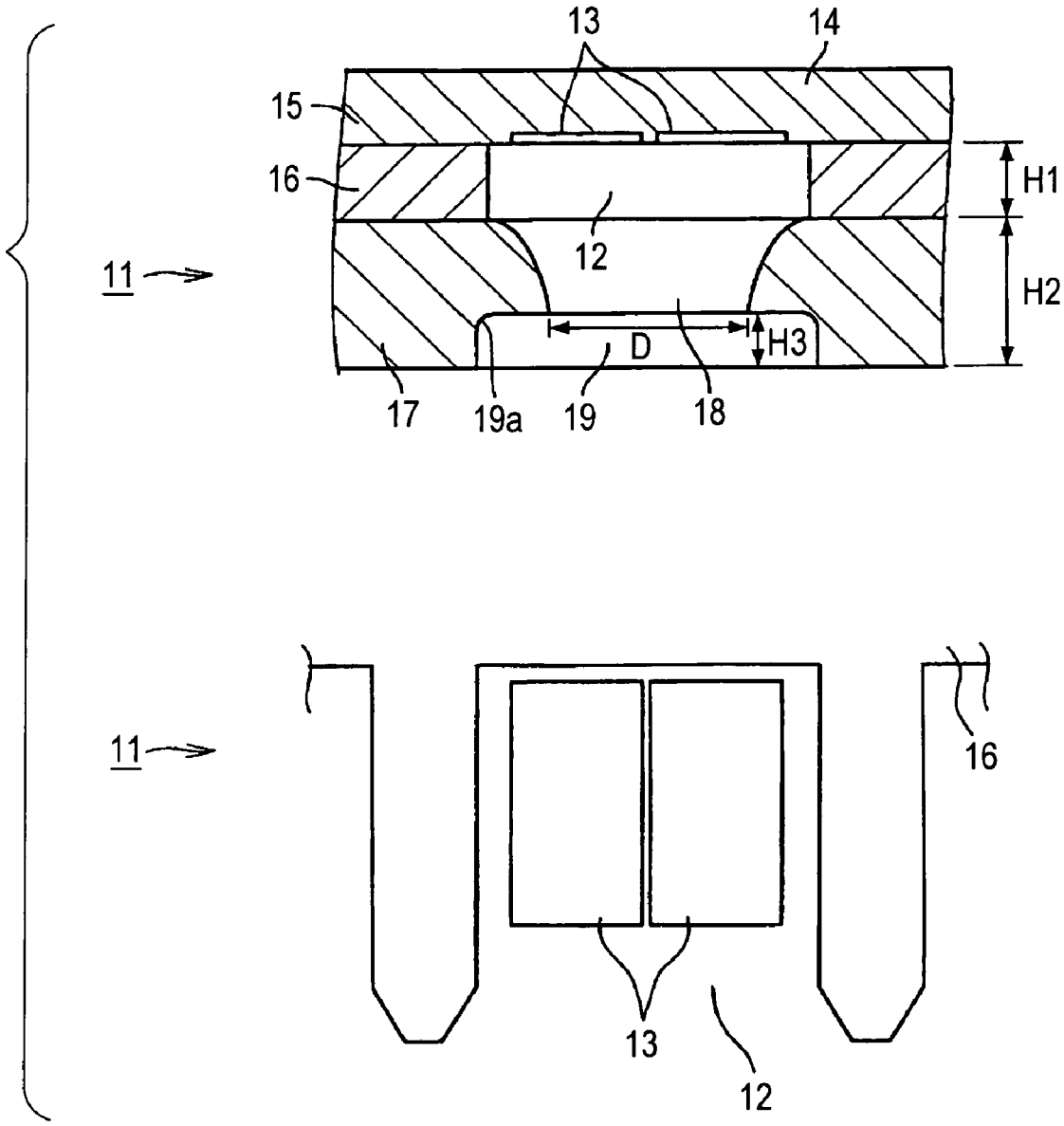
FIG. 2 illustrates a side sectional view and a bottom view of a nozzle of the printer head according to the first embodiment.

FIG. 2 illustrates a side sectional view and a bottom view of the nozzle 18 of the printer head 11 shown in FIG. 1 according to the first embodiment. In the bottom view, the nozzle sheet 17 is not shown.

As shown in FIG. 2, in each of the ink chambers 12 of the printer head 11, the two divided portions of the heating element 13 are arranged in parallel. That is, the heating element 13 includes the two portions, each of which has the length greater than the width. The two portions are arranged so that one of the long sides of one portion faces one of the long sides of the other portion. The arrangement direction of the divided two portions coincides with the arrangement direction of the nozzles 18.

In the case where each of the ink chambers 12 includes two divided portions of the heating element 13, if the periods of time in which the temperatures of the two divided portions of the heating element 13 reach the boiling temperature of ink (i.e., bubble generating time) are the same, the quantities of ink on the two divided heating elements 13 boil at the same time. As a result, an ink droplet is ejected in a direction perpendicular to the nozzle sheet 17 (i.e., direction of the central axis of the nozzle 18).

In contrast, if the bubble generating times for the two portions are different by controlling the two portions of the heating element 13 applying energy to the ink, the quantities of ink on the two portions of the heating elements 13 do not boil at the same time. As a result, an ink droplet is ejected in a direction offset from the central axis of the nozzles 18. That is, the ink droplet is ejected while being deflected.

As described above, according to the inkjet printer including the printer head 11 of the first embodiment, the ejection direction of an ink droplet can be deflected. That is, by controlling the deflection width in the ejection direction, an ink droplet can be deposited on a print paper sheet at a desired position. For example, four nozzles 18 can eject ink droplets onto the same position. Accordingly, white streaking is efficiently prevented in an image printed by the printer head 11 according to the first embodiment, thereby providing superior print quality.

Figure 3:
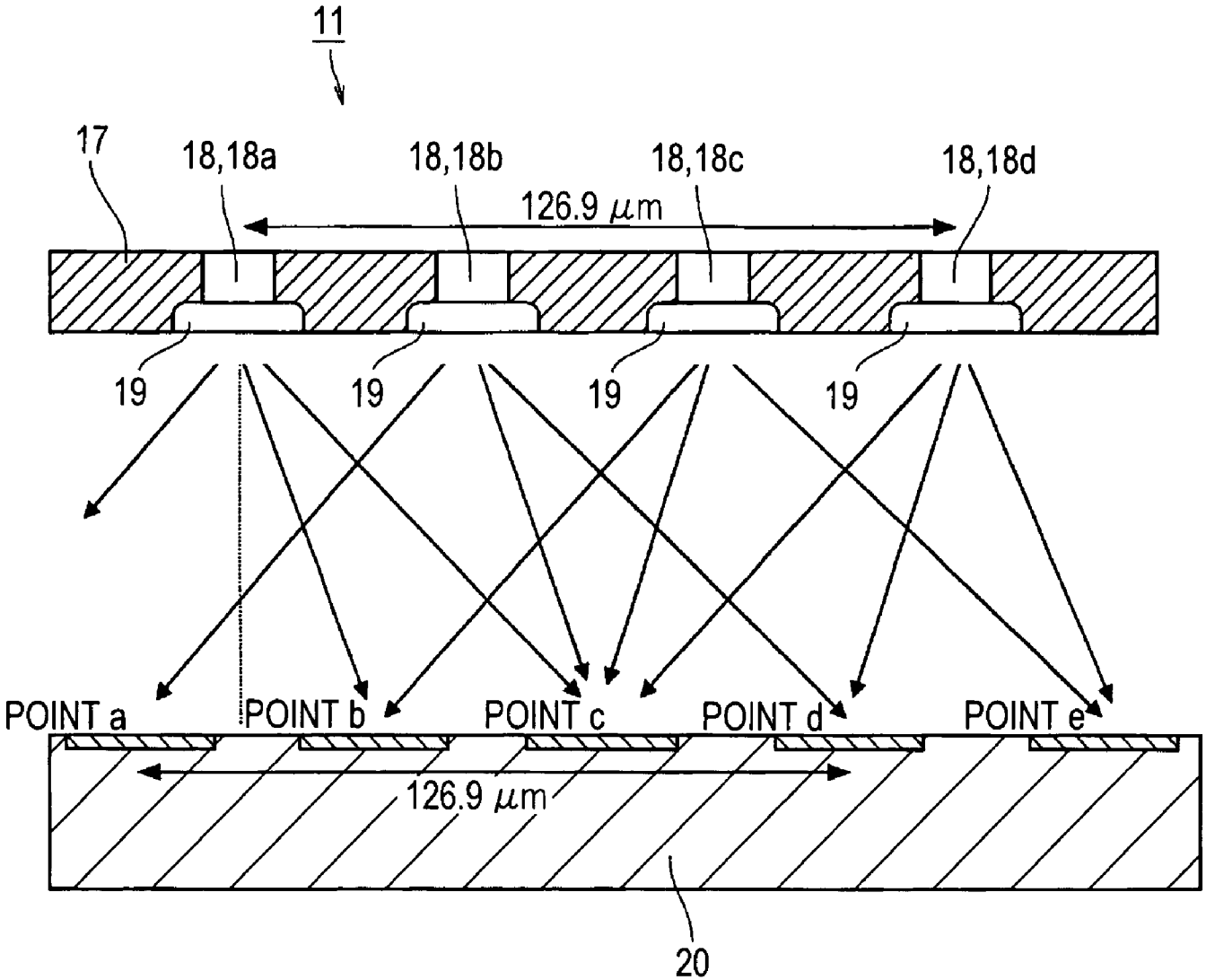
FIG. 3 illustrates the deflection of the ejection direction of an ink droplet ejected by the printer head according to the first embodiment.

FIG. 3 illustrates the deflection of the ejection direction of an ink droplet ejected by the printer head 11 according to the first embodiment.

As shown by an arrow in FIG. 3, the printer head 11 according to the first embodiment can eject an ink droplet while deflecting the ejection direction thereof with respect to the center axis (shown by a dotted line) of the nozzle 18. By independently controlling the deflection widths of ink droplets ejected from four nozzles 18 (18*a* to 18*d*) formed in the nozzle sheet 17, the ink droplets can be deposited on a print paper sheet 20 at, for example, points a, b, c, d, and e.

Here, the distance between the leftmost nozzle 18*a* and the rightmost nozzle 18*d* is 126.9 μm. The distance between the points a and d (i.e., distance between two points which are located at either side of the four deposited points) on the print paper sheet 20 is also 126.9 μm. Therefore, if, for example, three nozzles 18*b*, 18*c*, and 18*d* become unejectable for some reason, the deflection width of more than or equal to 120 μm for the ejection direction of an ink droplet of the nozzle 18*a* is needed to prevent the occurrence of white streaking by using the nozzle 18*a*. According to the printer head 11 of the first embodiment, the depression 19 of the nozzle sheet 17 provides the deflection width of more than or equal to 120 μm, thereby improving the print quality.

The operation of the depression 19 is now herein described.

It is known that the deflection width of the ejection direction of an ink droplet has correlation with a ratio D/H which is a ratio of an opening width (nozzle opening width) D of the nozzle 18 to a distance (ink chamber distance) H between the surface of the heating element 13 (see FIG. 2) and an ink droplet ejection surface. In the case of the nozzle 18 having a circular opening (nozzle shape), the nozzle opening width is a diameter of the circular opening. While, in the case of the nozzle 18 having a noncircular opening, the nozzle opening width is the maximum width of the opening. For example, in the case of the nozzle 18 having an elliptical opening, the nozzle opening width is the length of the long axis of the elliptical opening.

Figure 4:
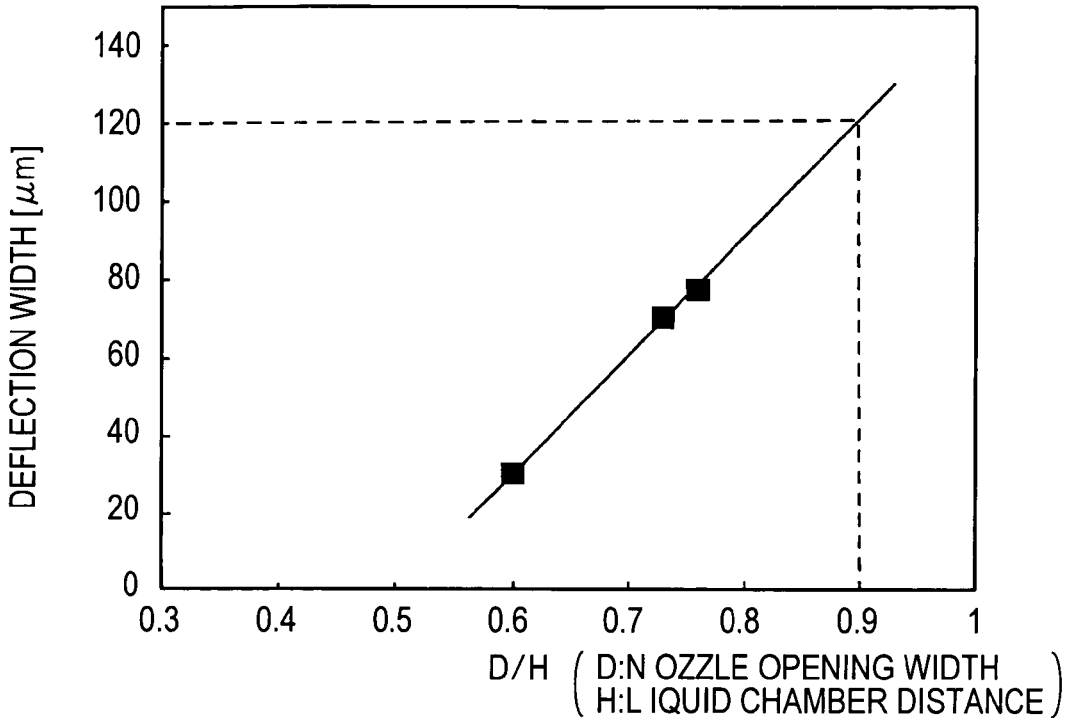
FIG. 4 is a graph representing a relationship between the deflection width of the ejection direction of an ink droplet and the ratio D (nozzle opening width)/H (ink chamber distance)

FIG. 4 is a graph representing a relationship between the deflection width of the ejection direction of an ink droplet and the ratio D (nozzle opening width)/H (ink chamber distance). In the graph shown in FIG. 4, the deflection voltage applied to the heating element 13 (see FIG. 2) is 3.015 V, and a material for forming the barrier layer 16 (see FIG. 2) is chosen so that the deflection width becomes maximum. Furthermore, the distance between the surface (ejection surface) of the nozzle sheet 17 (see FIG. 3) and the print paper sheet 20 (see FIG. 3) is determined to be 2 mm.

As shown in FIG. 4, to ensure the deflection width is more than or equal to 120 μm, the ratio D/H needs to be more than or equal to 0.9. Here, since the ink chamber distance H is a distance between the surface of the heating element 13 (see FIG. 2) and the ink droplet ejection surface, the ink chamber distance H=a height H1 of the ink chamber 12 (see FIG. 2)+a thickness H2 of the nozzle sheet 17 (see FIG. 2), where the depression 19 (see FIG. 2) is not formed. Since, for the printer head 11 according to the first embodiment, H1=10 μm and H2=13 μm, H=23 μm. Therefore, to obtain the ratio D/H of more than or equal to 0.9, the nozzle opening width D must be greater than or equal to about 21 μm.

Consequently, according to the graph shown in FIG. 4, the nozzle opening width D can be computed using a required deflection width. Additionally, even when no depression 19 shown in FIG. 2 is formed on the nozzle sheet 17, the nozzle 18 which is formed on the nozzle sheet 17 and which has an elliptical shape with a long axis length of 21 μm and a short axis length of 18 μm can provide a deflection width of 120 μm on the print paper sheet 20 shown in FIG. 3.

However, the nozzle 18 having an elliptical shape with a long axis length of 21 μm and a short axis length of 18 μm causes a problem in that the density of a printed image is high and the printed image is grainy due to a large size of an ink droplet deposited on the print paper sheet 20. That is, when the nozzle opening width D is determined simply by the deflection width, the print quality is degraded.

Accordingly, the relationship between the size (diameter) of a deposited ink droplet and the shape (dimensions of the opening area) of the nozzle 18 is now herein described.

Figure 5:
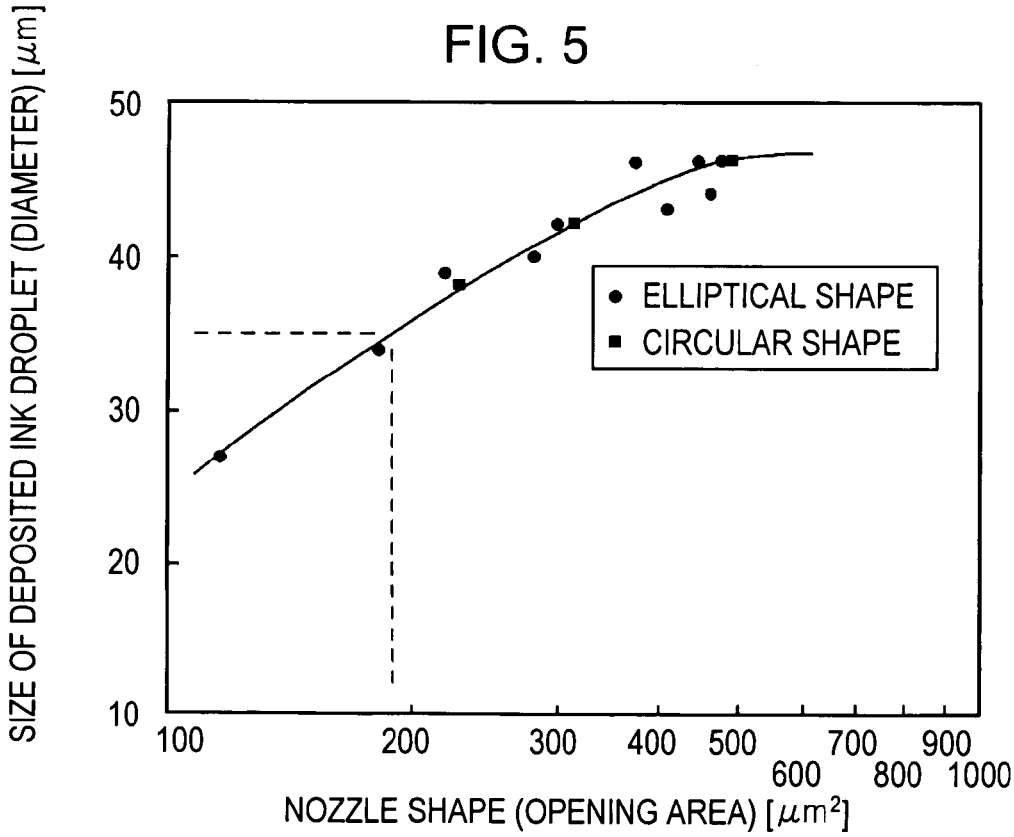
FIG. 5 is a graph representing a relationship between the size (diameter) of a deposited ink droplet and the shape (dimensions of the opening area) of a nozzle.

FIG. 5 is a graph representing a relationship between the size (diameter) of a deposited ink droplet and the shape (dimensions of the opening area) of the nozzle 18. Here, the nozzle 18 has two types of a nozzle shape: an elliptical shape and a circular shape.

As shown in FIG. 5, as the shape (dimensions of the opening area) of the nozzle 18 increases, the size (diameter) of a deposited ink droplet increases. However, it is known that, if the size (diameter) of a deposited ink droplet is smaller than or equal to 35 μm, the naked eye cannot recognize the ink droplet, and therefore, ink dots are not noticeable. Accordingly, to prevent degradation of the print quality, the size (diameter) of a deposited ink droplet of smaller than or equal to 35 μm is desirable.

As can be seen from the graph shown in FIG. 5, the nozzle shape (dimensions of the opening area) that provides the size (diameter) of a deposited ink droplet smaller than or equal to 35 μm has dimensions of the opening of smaller than 200 $\mu m^2$. Here, when the nozzle has an elliptical shape with the long axis length of 16 μm and the short axis length of 14 μm, the dimensions of the opening (the long axis length×the short axis length×π/4) is 175.8 $\mu m^2$. That is, if the nozzle has such a nozzle shape (dimensions of the opening area), the size (diameter) of a deposited ink droplet can be about 35 μm, thus preventing the degradation of print quality.

Next, the ink chamber distance H is calculated from the nozzle shape (dimensions of the opening area).

When the nozzle has an elliptical shape with the long axis length of 16 μm and the short axis length of 14 μm, the nozzle opening width D is 16 μm. Therefore, according to the graph shown in FIG. 4, the ink chamber distance H that satisfies the ratio D/H greater than or equal to 0.9 is about 18 μm. Additionally, in the first embodiment, the height H1 of the ink chambers 12 of the printer head 11 (see FIG. 2) is about 10 μm. Consequently, when the nozzle sheet 17 does not have the depression 19, a thickness H2 of the nozzle sheet 17 (see FIG. 2) is about 8 μm. As stated above, the thickness H2 can be calculated from a desired size (diameter) of a deposited ink droplet and a required deflection width according to the graphs shown in FIGS. 4 and 5.

However, in a print experiment, the uniform thickness H2 of 8 μm across the nozzle sheet 17 generated a problem in that a large amount of satellite ink droplets or a mist of ink droplets was generated and the deflection width of an ejected ink droplet was different depending on the position of the nozzle 18. The observation of the ejecting nozzle 18 using a laser doppler indicated that the surface of the nozzle sheet 17 vibrated and this vibration caused the ejection state to be unstable. As a result, the image quality was degraded. This indicates that the thickness H2 of the nozzle sheet 17 has a minimum value. The thickness H2 of the nozzle sheet 17 that provides a stable ejection of ink droplets is greater than about 13 μm, since this thickness can maintain the rigidity of the nozzle sheet 17.

As described above, the demand to decrease the thickness of the nozzle sheet 17 conflicts with the demand to maintain the rigidity of the nozzle sheet 17. According to the printer head 11 of the first embodiment, to meet both demands, the depression 19 is formed around the nozzle 18, as shown in FIG. 2. That is, the opening width (nozzle opening width) D of the nozzle 18 is set to be 16 μm (i.e., the nozzle 18 has an elliptical shape with a long axis length of 16 μm and a short axis length of 14 μm). Additionally, the nozzle sheet 17 is employed in which an elliptical depression 19 (the long axis length of 28 μm) larger than the elliptical nozzle 18 is formed around the nozzle 18.

The uniform thickness H2 across the nozzle sheet 17 is set to 13 μm in order to maintain the rigidity of the nozzle sheet 17. A depth H3 of the depression 19 is set to be 5 μm. Therefore, in the vicinity of the nozzle 18, the thickness of the nozzle sheet 17 is considered to be 8 μm, and the distance (liquid chamber distance) between the surface of the heating element 13 and the ink droplet ejection surface is 18 μm. Accordingly, the printer head 11 according to the first embodiment can provide an optimum size (diameter) of a deposited ink droplet and a desired deflection width as well.

Figure 14:
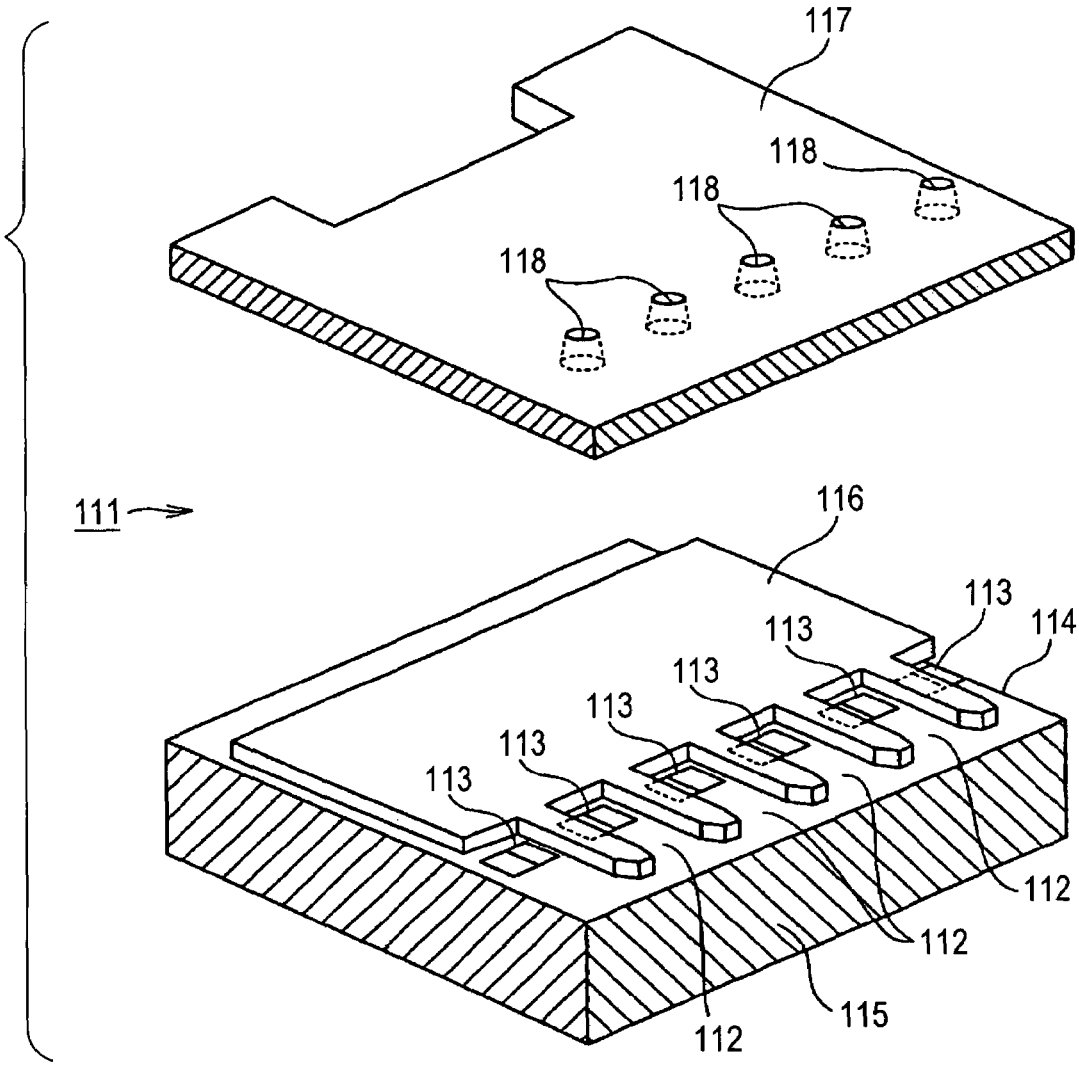
FIG. 14 is an exploded perspective view of a known printer head.

As described above, the printer head 11 according to the first embodiment has the depression 19 on the front surface of the nozzle sheet 17 compared with the known printer head 111 shown in FIG. 14. Other components including the ink chambers 12 have similar shapes to those of the known printer head 111. The nozzle opening width D of the nozzle 18 has the same value as that of the known printer head 111. Accordingly, when an ink droplet is vertically ejected, the ejection characteristic of the ink droplet and the size of a deposited ink droplet are exactly the same as those of the known printer head 111 shown in FIG. 14. Additionally, since the uniform thickness H2 across the nozzle sheet 17 of the printer head 11 is the same as that of the known printer head 111, the rigidity of the nozzle sheet 17 is the same as that of the known printer head 111.

The depression 19 is formed only around the nozzle 18. Accordingly, the printer head 11 according to the first embodiment can largely deflect the ejection direction of an ink droplet compared with the known printer head 111 shown in FIG. 14. That is, according to the printer head 11 of the first embodiment, the depression 19 formed on the front surface of the nozzle sheet 17 can meet both the demand to maintain the rigidity of the nozzle sheet 17 and the demand to deflect the ejection direction of an ink droplet.

Furthermore, in the depression 19 of the nozzle sheet 17 in the printer head 11 according to the first embodiment, a bottom corner 19*a* of the depression 19 is not quite a right angle, but is greater than 90 degrees. Accordingly, in the printer head 11 according to the first embodiment, ink is not deposited to the interior of the depression 19 so that the ink is not accumulated in the bottom corner 19*a*. As a result, degradation of the print quality due to the ink accumulation can be prevented.

That is, in general, continuous printing causes ink overflow or a mist of ejected ink. This ink is accumulated in the depression 19. If the depression 19 is fully filled with the ink, an area whose density gradually becomes higher or an area where the ink is not deposited at a desired position due to the slow-down of the ejection speed may be generated in a printed image. Also, the deflection width of the nozzle 18 may be reduced. Furthermore, if the accumulated ink becomes solidified into solid ink, the solid ink may clog the nozzle 18, and therefore, the print quality is degraded.

However, in the printer head 11 according to the first embodiment, as shown in FIG. 2, the bottom corner 19*a* of the depression 19 is greater than 90 degrees and the bottom corner 19*a* has a curved surface. Accordingly, ink is not accumulated in the depression 19. Therefore, the print quality is not degraded.

The relationship between the shape of the bottom corner 19*a* of the depression 19 and the accumulation of ink is now herein described.

Figure 6:
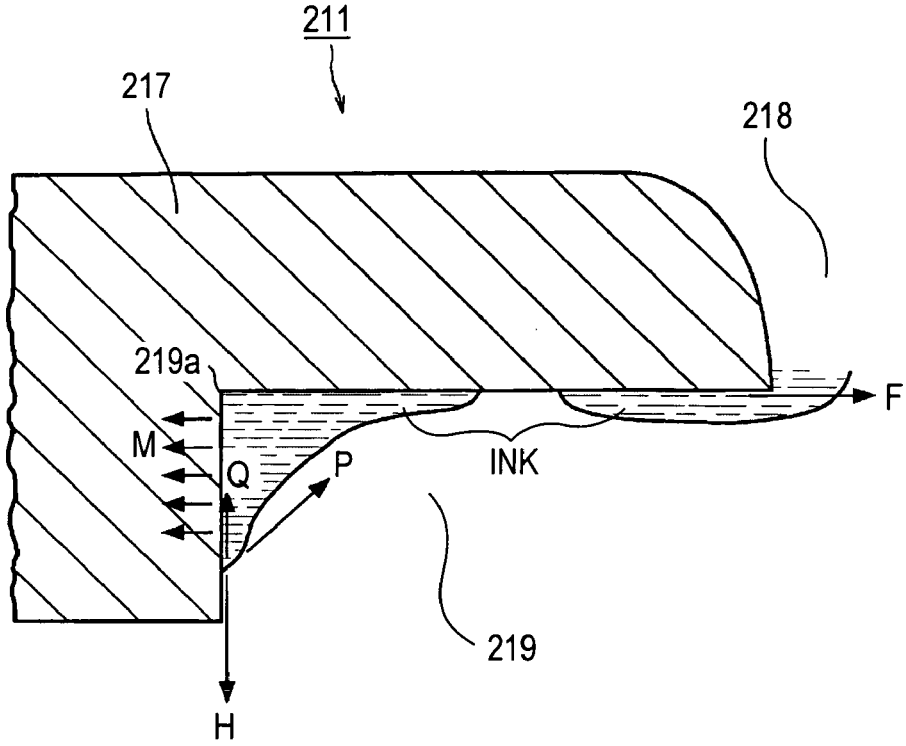
FIG. 6 is a partial sectional view of a depression of a nozzle sheet in a printer head of a comparative example.

FIG. 6 is a partial sectional view of a depression 219 of a nozzle sheet 217 in a printer head 211 of a comparative example.

As shown in FIG. 6, unlike the depression 19 of the printer head 11 shown in FIG. 2 according to the first embodiment, a bottom corner 219*a* of the depression 219 in the printer head 211 of the comparative example is a right angle. Therefore, ink is accumulated in the bottom corner 219*a*.

More specifically, after a nozzle 218 ejects an ink droplet, ink deposited to the interior of the depression 219 is drawn back into the nozzle 218. This is because the pressure inside an ink chamber (not shown) is set to be lower than the atmospheric pressure in order to prevent the ink from leaking due to a capillary force or gravity. If all the ink deposited to the interior of the depression 219 is drawn back into the nozzle 218, the ink is not accumulated in the depression 219 at all.

However, as shown in FIG. 6, a surface tension H between a member of the nozzle sheet 217 and the air, a surface tension P between the ink and the air, and a surface tension Q between the ink and the member of the nozzle sheet 217 act on the bottom corner 219*a* of the depression 219. If the surface tension H is greater than the total force of the direction cosine of the surface tension P in the vertical direction and the surface tension Q, the ink spreads in a direction of the surface tension H, and therefore, the ink rises.

In the printer head 211 of the comparative example shown in FIG. 6, the bottom corner 219*a* is a right angle. Accordingly, the rise of the ink increases an area that generates an adhesive force M, thus generating a relatively strong adhesive force M. Consequently, when the ink is drawn back into the nozzle 218, the ink deposited to the depression 219 is cut out at a position between the nozzle 218 and the bottom corner 219*a*, and therefore, some of the ink is accumulated in the bottom corner 219*a*. If the adhesive force M is increased, all the ink is drawn back into the nozzle 218 without being cut out, and therefore, the accumulation of the ink can be prevented.

Figure 7:
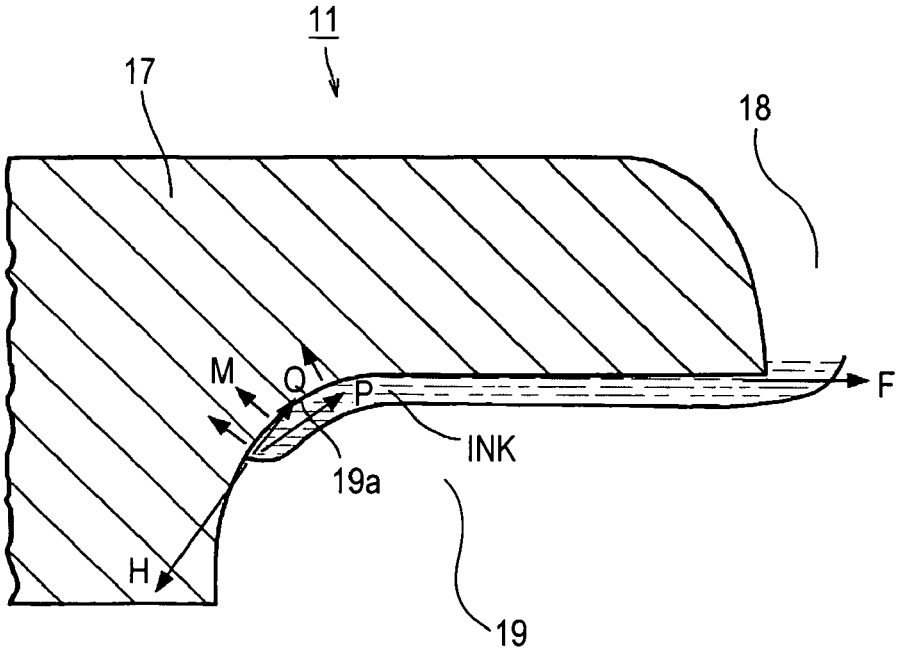
FIG. 7 is a partial sectional view of the depression of the nozzle sheet in the printer head according to the first embodiment.

FIG. 7 is a partial sectional view of the depression 19 of the nozzle sheet 17 in the printer head 11 according to the first embodiment.

As shown in FIG. 7, the depression 19 having an opening width greater than the nozzle 18 is formed on the surface of the nozzle sheet 17. Additionally, the bottom corner 19*a* of the depression 19 has a rounded shape (curved surface), which is greater than 90 degrees. Accordingly, the direction cosine of the surface tension P in the slope direction is greater than that in the comparative example shown in FIG. 6. Consequently, the force to spread the ink in the direction of the surface tension H is decreased.

Additionally, an inkjet printer incorporating the printer head 11 includes a pressure suppression mechanism using a permeable film (e.g., sponge) based on Darcy's law for providing a resistance force to an air inlet port of an ink tank (not shown) so that the pressure in an ink chamber (not shown) is lower than the atmospheric pressure. Accordingly, after the nozzle 18 ejects an ink droplet, ink deposited to the interior of the depression 19 is drawn back into the nozzle 18. Furthermore, by providing a valve that is open only when the pressure is lower than or equal to a predetermined value, a pressure that is lower than the atmospheric pressure can be applied.

As described above, according to the printer head 11 of the first embodiment, the rounded shape of the bottom corner 19*a* of the depression 19 prevents ink from spreading in the direction of the surface tension H. Thus, the area that generates the adhesive force M is decreased. Also, only a horizontal component of the adhesive force M acts on the ink. Accordingly, when the nozzle 18 ejects an ink droplet and a pressure lower than the atmospheric pressure acts on the ink in the nozzle 18, ink deposited to the interior of the depression 19 is drawn back into the nozzle 18 without being cut out, as shown in FIG. 7, and the ink deposited to the interior of the depression 19 is returned to inside the nozzle 18. As a result, the accumulation of the ink in the depression 19 can be prevented, and therefore, the print quality is not degraded.

Second Exemplary Embodiment

Figure 8:
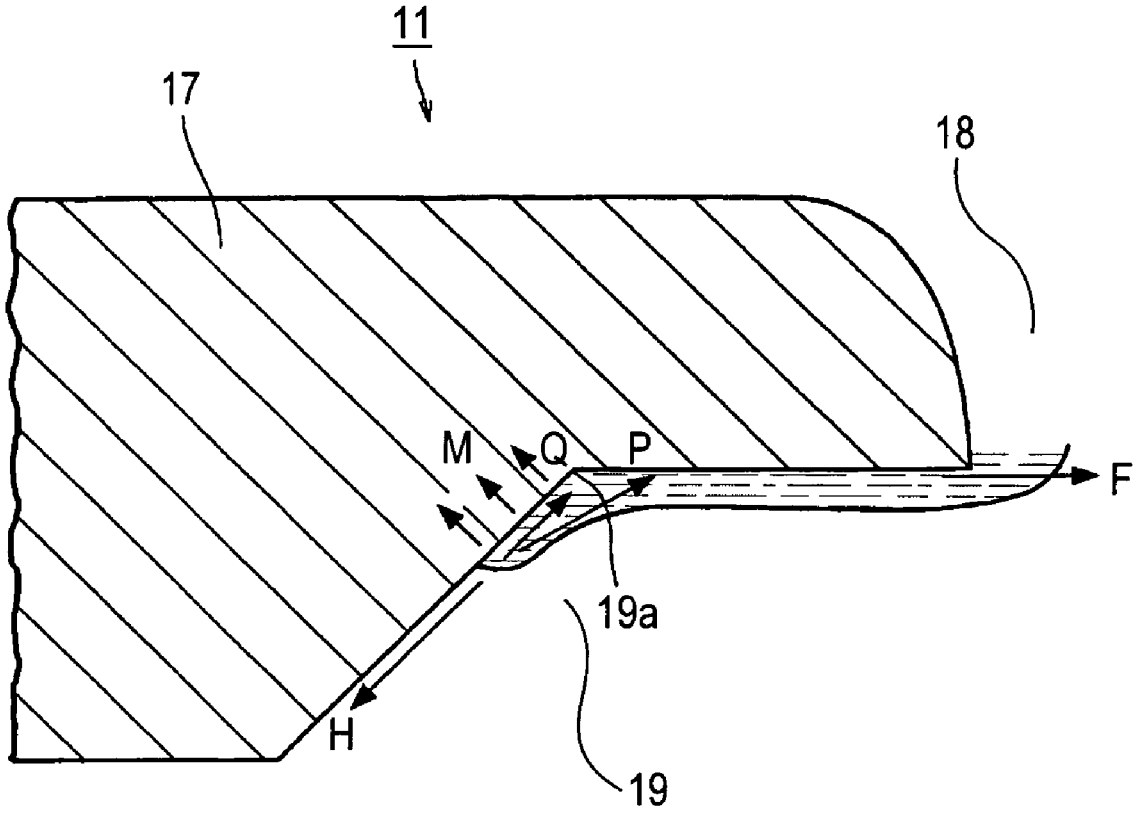
FIG. 8 is a partial sectional view of a depression of a nozzle sheet in a printer head according to a second embodiment.

FIG. 8 is a partial sectional view of a depression 19 of a nozzle sheet 17 in a printer head 11 according to a second exemplary embodiment.

As shown in FIG. 8, in the second embodiment, a bottom corner 19*a* of the depression 19 formed on the front surface of the nozzle sheet 17 has a slope shape (a sloping surface), which is greater than 90 degrees.

Like the first embodiment, in the printer head 11 according to the second embodiment, the slope of the bottom corner 19*a* of the depression 19 prevents ink from spreading in a direction of the surface tension H and an area that generates the adhesive force M is reduced. Accordingly, as shown in FIG. 8, ink deposited to the interior of the depression 19 is drawn back into the nozzle 18 without being cut out, and the ink deposited to the interior of the depression 19 is returned to inside the nozzle 18. As a result, the accumulation of the ink in the depression 19 can be prevented, and therefore, the print quality is not degraded.

Third Exemplary Embodiment

Like the printer head 11 according to the first embodiment shown in FIG. 7, in a printer head 11 according to a third embodiment, the bottom corner 19*a* of the depression 19 has a rounded shape (curved surface). In the third embodiment, a surface of the nozzle sheet 17 including the depression 19 is treated with a water-repellent finish. Accordingly, the spreading force of the ink in a direction of the surface tension H is further decreased, and an area that generates the adhesive force M is further reduced. Also, a horizontal component of the adhesive force M is further decreased. As a result, the accumulation of the ink in the depression 19 can be prevented, and therefore, the print quality is not degraded.

As described above, in the printer head 11 according to this embodiment, the depression 19 having an opening width greater than the nozzle 18 is formed on the surface of the nozzle sheet 17. Additionally, the bottom corner 19*a* of the depression 19 is greater than 90 degrees. Additionally, in the inkjet printer including the printer head 11 according to this embodiment, the pressure lower than the atmospheric pressure causes the ink deposited to the interior of the depression 19 to return to inside the nozzle 18.

In an experiment to continuously print 1000 pages at a speed of a page per 6 seconds using the inkjet printer including the printer head 11 according to the first embodiment, no problem occurred. The examination of the depression 19 after the printing indicated that the ink deposited to the interior of the depression 19 was returned to inside the nozzle 18, since the bottom corner 19*a* had a rounded shape (curved surface).

The fabrication method of the printer head 11 is now herein described.

Fourth Exemplary Embodiment

In a fabrication method of the printer head 11 according to a fourth exemplary embodiment, the nozzle sheet 17 including the nozzle 18 and the depression 19 as shown in FIG. 1 is bonded to the barrier layer 16 in a tail-end processing step. That is, in the fabrication method of the printer head 11 according to the fourth embodiment, the semiconductor substrate 15, which is the substrate member 14, is prepared first. The semiconductor substrate 15 is composed of, for example, silicon, glass, or a ceramic material. Subsequently, the heating element 13 is formed on a surface (top surface in FIG. 1) of the semiconductor substrate 15 by deposition using a fine processing technology for a semiconductor or electronic device fabrication. For example, a material for the heating element 13 is coated on the surface of the semiconductor substrate 15 by a sputtering process using plasma.

Thereafter, the barrier layer 16 is formed with a photosensitive resin on the surface of the substrate member 14 adjacent to the heating elements 13 (top surface in FIG. 1). That is, the photosensitive resin is patterned on the surface of the substrate member 14 in areas excluding the area for the heating elements 13 so as to form the barrier layer 16. By bonding the nozzle sheet 17 onto the barrier layer 16, the printer head 11 is fabricated. Here, the nozzles 18 and the depressions 19 are formed in the nozzle sheet 17.

The fabrication process of the nozzle sheet 17 is now herein described in detail.

Figure 9:
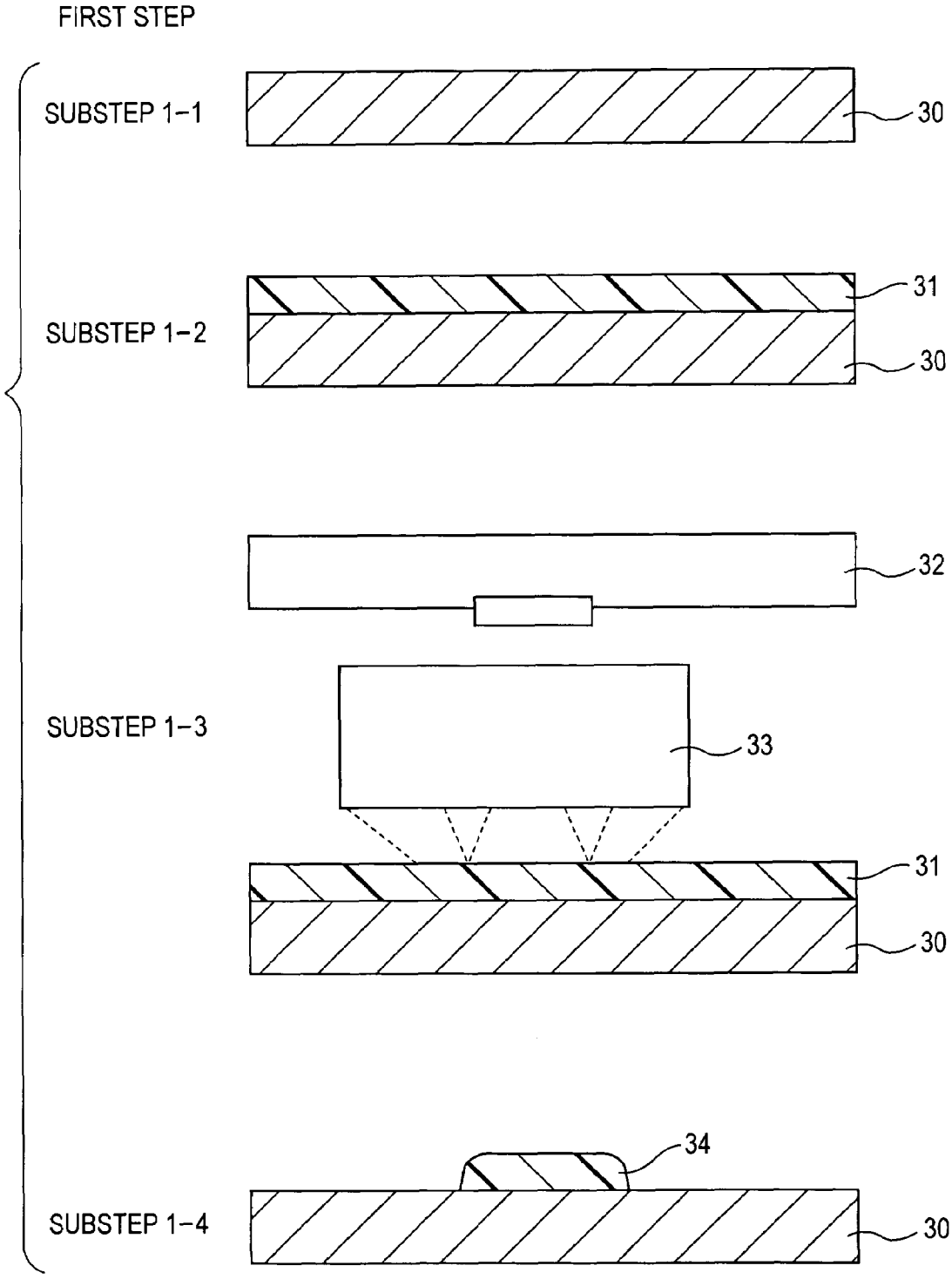
FIG. 9 illustrates a first step of a fabrication process of a nozzle sheet in a fabrication method of the printer head according to a fourth embodiment.

FIG. 9 illustrates a first step of the fabrication process of the nozzle sheet 17 in the fabrication method of the printer head 11 according to the fourth embodiment.

In the first step, as shown in FIG. 9, a resist pattern 34 corresponding to the depression 19 (see FIG. 2) is formed on a mother mold 30. That is, in substep 1-1 of the first step shown in FIG. 9, a metallic electroforming substrate serving as a mother mold 30 is prepared. In this embodiment, the mother mold 30 may be a widely used SUS (stainless steel). More specifically, the mother mold 30 can be a conductive substrate of SUS 304 having a size of 400 mm by 400 mm and a thickness of 0.4 mm. However, a metallic material other than SUS may be used as the mother mold 30.

In the subsequent substep 1-2, a resist layer 31 having a thickness of about 5 μm is formed on the mother mold 30. The resist layer 31 is composed of a photosensitive resin. For the subsequent exposure step using a projection exposure apparatus, the photosensitive resin is a novolac resin-based positive photoresist that is sensitive to i, g, and h lines. In the fourth embodiment, in order to form the resist layer 31 by applying a novolac resin-based positive photoresist on the mother mold 30, a spin coating method is employed. However, in addition to the spin coating method, the bar coating method, the curtain coating method, the meniscus coating method, or the spray coating method may be employed.

In the subsequent substep 1-3, exposure is performed by a projection photolithographic system (not shown). The resist layer 31 is exposed using a mask 32 that covers only an area for the depression 19 (see FIG. 2) so that the resist layer 31 in the area for the depression 19 selectively remains. At that time, to provide a round shape (curved surface) to the bottom corner 19*a* (see FIG. 2) of the depression 19, the exposure light is defocused such that the surface of the mother mold 30 moves towards a projection lens 33 with respect to a focusing surface of the projection photolithographic system. Also, a filter is removed from a light source to use mixed light of i, g, and h lines. In the case of using a negative resist for the resist layer 31, the mask pattern is reversed and the exposure light is defocused such that the surface of the mother mold 30 moves away from the projection lens 33.

In the subsequent substep 1-4, the resist layer 31 exposed in substep 1-3 is developed with predetermined developing fluid to form the resist pattern 34. The formed resist pattern 34 corresponds to the depression 19 (see FIG. 2). As shown by substep 1-4 in FIG. 9, the corners of the top surface of the resist are rounded so that the round shape is provided to the bottom corner 19*a* (see FIG. 2).

In the fourth embodiment, exposure is performed by the projection photolithographic system. However, the projection photolithographic system is not limited to this application. That is, even a contact exposure method that uses parallel light and image blurring caused by Fresnel diffraction can produce a round shape of the corners of the top surface of the resist. Additionally, in the case of a resist that uses a radical reaction, exposure to an oxygen atmosphere can cause film reduction so as to produce a round shape of the corners of the top surface of the resist. Furthermore, in the case of a negative resist of a chemical amplification type, use of alkaline components in the air can produce a round shape of the corners of the top surface of the resist.

Figure 10:
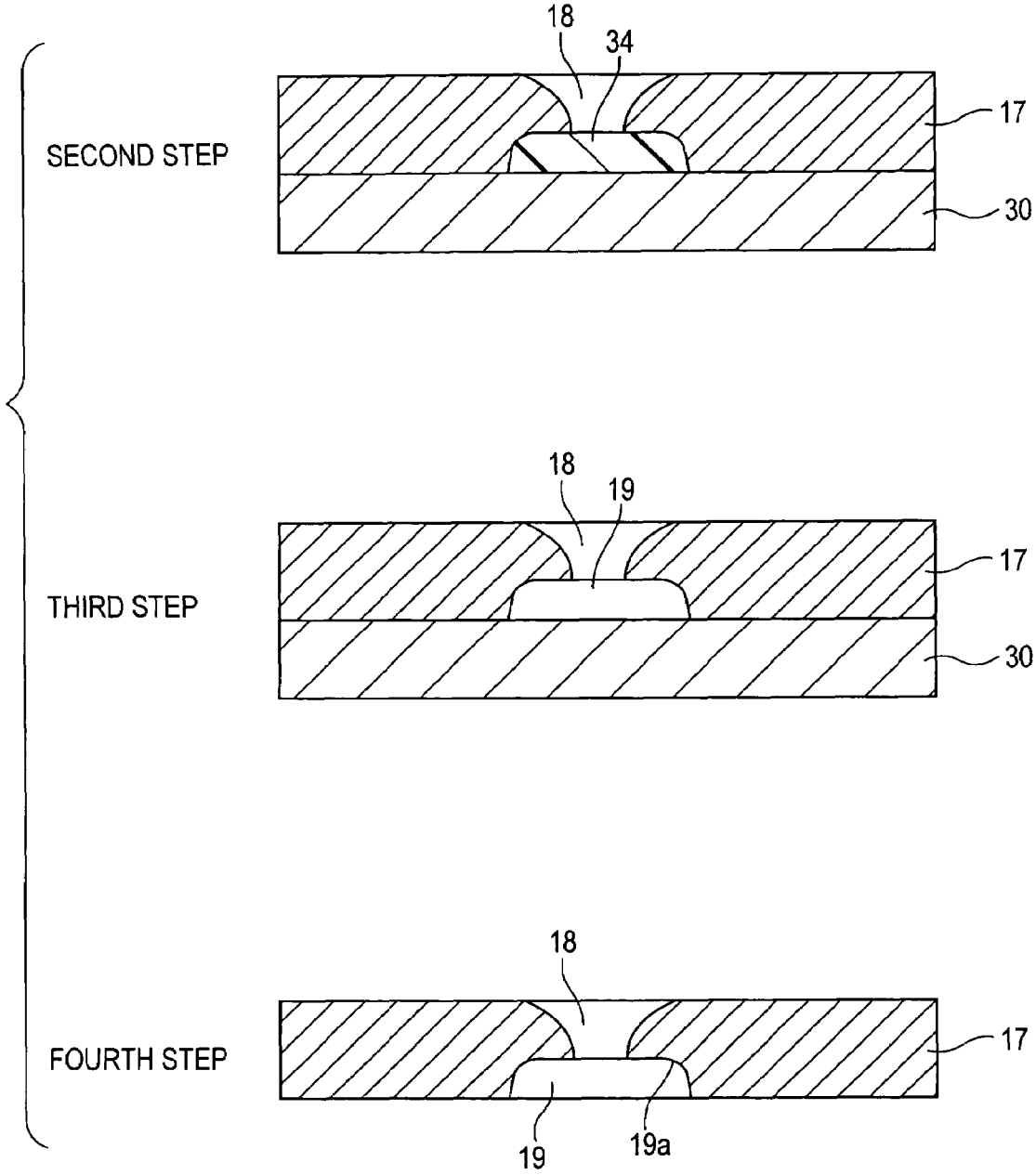
FIG. 10 illustrates a second step to a fourth step of the fabrication process of the nozzle sheet in the fabrication method of the printer head according to the fourth embodiment.

FIG. 10 illustrates a second step to a fourth step of the fabrication process of the nozzle sheet 17 in the fabrication method of the printer head 11 according to the fourth embodiment.

As shown in FIG. 10, after the first step (see FIG. 9) is completed, an electroforming layer is formed on the mother mold 30 in the second step. In the third step, the resist pattern 34 is removed. In the fourth step, the mother mold 30 is stripped off so as to form the nozzle sheet 17.

That is, in the second step shown in FIG. 10, an electrode plate is attached to the mother mold 30. The electroforming layer having a thickness of about 13 μm is formed on the mother mold 30 and the resist pattern 34 by electrolytic plating. The electroforming layer is primarily composed of nickel (Ni). Here, the electroforming layer is not formed on the central portion of the resist pattern 34 so that the portion corresponding to the nozzle 18 is removed. This is because an electric current does not flow in the resist pattern 34. Accordingly, in the second step shown in FIG. 10, the electroforming layer can become the nozzle sheet 17 including the nozzle 18.

The nozzle sheet 17 may be formed from, for example, nickel-cobalt (Ni—Co) alloy (in which cobalt content ranges from about 10 to 20%), instead of pure nickel (Ni). Examples of the chemicals include, in the case of a nickel sulfamate plating bath, a mixed liquid of nickel sulfamate, nickel chloride, boric acid, and stress control and anti-pit additives, and, in the case of a Waisberg nickel plating bath, a mixed liquid of nickel sulfate, nickel chloride, cobalt sulfate, boric acid, nickel formate, sulfate of ammonia, and formaldehyde.

Subsequently, in the third step, the resist pattern 34 is removed to form the depression 19 in the electroforming layer. To remove the resist pattern 34, alkaline solution or organic solution can be used. Thus, the electroforming layer can become the nozzle sheet 17 in which the nozzle 18 and the depression 19 are formed. Since the shape of the resist pattern 34 is directly transferred onto the depression 19, the rounded bottom corner 19*a* having a high dimensional precision is formed.

Subsequently, in the fourth step, the electroforming layer (the nozzle sheet 17) is stripped off the mother mold 30. Thus, the nozzle sheet 17 is formed in which the nozzle 18 and the depression 19 are formed. Thereafter, in the fifth step, as shown in FIG. 1, each of the nozzles 18 is precisely positioned at the heating element 13, that is, each of the nozzles 18 faces one of the heating elements 13. The nozzle sheet 17 is then bonded to the barrier layer 16 such that the surface having the depression 19 faces upwards. As a result, as shown in FIG. 2, the nozzle sheet 17 is bonded to the substrate member 14 with the barrier layer 16 therebetween. Thus, the printer head 11 is fabricated.

Fifth Exemplary Embodiment

Like the fourth embodiment, in a printer head 11 according to a fifth embodiment, the nozzle sheet 17 in which the nozzle 18 and the depression 19 are formed is bonded in a tail-end processing. That is, by bonding the nozzle sheet 17 onto the substrate member 14 with the barrier layer 16 therebetween, the printer head 11 is fabricated. However, the fabrication process of the nozzle sheet 17 is different from that in the fourth embodiment.

Figure 11:
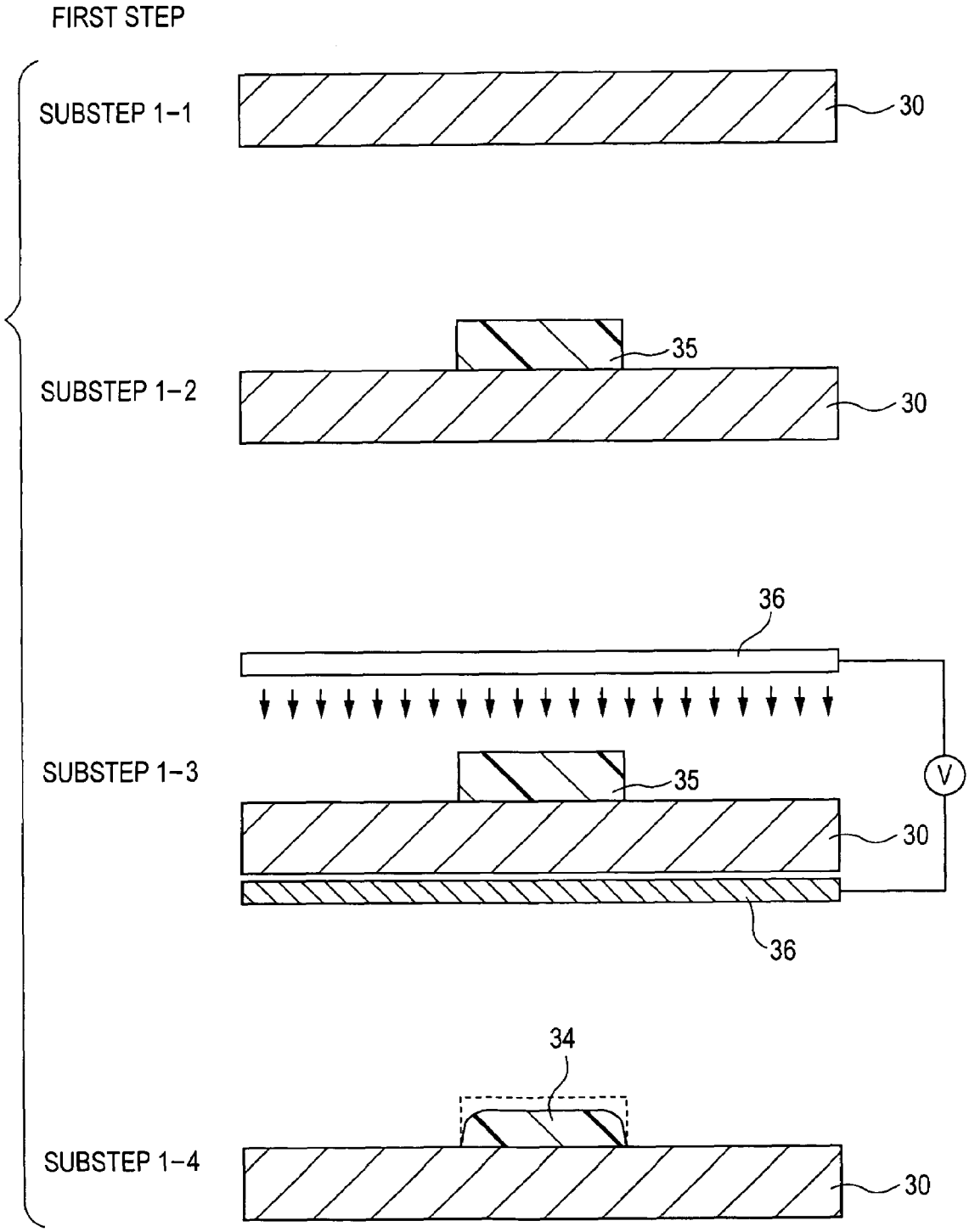
FIG. 11 illustrates a first step of a fabrication process of a nozzle sheet in a fabrication method of the printer head according to a fifth embodiment.

FIG. 11 illustrates a first step of the fabrication process of a nozzle sheet 17 in a fabrication method of a printer head 11 according to the fifth embodiment.

In the first step, as shown in FIG. 11, a resist pattern 34 corresponding to the depression 19 (see FIG. 2) is formed on a mother mold 30. That is, in substep 1-1 of the first step shown in FIG. 11, a metallic electroforming substrate serving as a mother mold 30 is prepared. In this embodiment, the mother mold 30 can be an electroforming substrate similar to that in the fourth embodiment.

In the subsequent substep 1-2, a resist layer 35 is formed on the mother mold 30. The resist layer 35 is composed of a photosensitive resin, as in the fourth embodiment. By performing an exposure process and a developing process, as shown in FIG. 11, the resist layer 35 is formed so that the resist layer 35 lies vertically and has a width corresponding to the depression 19 (see FIG. 2). That is, in the fourth embodiment, a resist pattern 34 (see FIG. 9) corresponding to the depression 19 (see FIG. 2) is formed by the exposure process and developing process. However, in the fifth embodiment, the vertical resist layer 35 having a width corresponding to the depression 19 (see FIG. 2) is formed first. Subsequently, the corners of the top of the resist are cut off.

In substep 1-3, the resist layer 35 is etched so that the corners of the top of the resist are cut off. That is, as shown in FIG. 11, the resist layer 35 and the mother mold 30 are disposed between electrodes 36. The resist layer 35 is then etched by hydrogen gas using a parallel-plate gas reactive dry etching system. However, the gas is not limited to hydrogen gas. Alternatively, the gas may be any gas capable of cutting off the resist even if only slightly, such as argon, oxygen, or chlorine gas. During the etching process, the side wall of the resist is protected from being cutting off. Furthermore, the level of etching can be appropriately controlled by changing the type of the gas, the density of the gas, the degree of vacuum, the voltage level, and the temperature.

In the subsequent substep 1-4, after the resist layer 35 is etched in substep 1-3, the mother mold 30 and the resist layer 35 is moved out from the dry etching system. That is, the corners of the resist layer 35 are removed by etching, and a resist pattern 34, as shown by substep 1-4 in FIG. 11, is formed. Thereafter, in the same manner as in the second step to fourth step in the fourth embodiment, an electroforming layer is formed on the mother mold 30 in the second step shown in FIG. 10. In the third step, the resist pattern 34 is removed. Finally, in the fourth step, the mother mold 30 is stripped off to form the nozzle sheet 17.

To form a vertical resist layer 35 and subsequently cut off the corners, instead of etching, the resist layer 35 may be heated to substantially the glass-transition temperature and may be made to be fluidized. By using this method, the corners of the resist layer 35 can also be removed and the resist pattern 34 shown by substep 1-4 in FIG. 11 can be formed.

Sixth Exemplary Embodiment

Like the fourth embodiment, in a printer head 11 according to a sixth embodiment, a nozzle sheet 17 in which a nozzle 18 and a depression 19 are formed is bonded in a tail-end processing. That is, by bonding the nozzle sheet 17 onto a substrate member 14 with a barrier layer 16 therebetween, the printer head 11 is fabricated. However, the fabrication process of the nozzle sheet 17 is different from that in the fourth embodiment.

That is, in the sixth embodiment, the nozzle 18 and the depression 19 are formed in the nozzle sheet 17 by laser processing to obtain the nozzle sheet 17 shown in the fourth step in FIG. 10. In the sixth embodiment, the nozzle sheet 17 is formed from a resin that is ink resistant and laser processable (e.g., polyimide). The nozzle 18 is formed in a resin film having such characteristics by excimer laser processing. The depression 19 is formed by cutting out the back surface of the nozzle sheet 17 while appropriately controlling the power of excimer laser so that the depression 19 becomes a blind hole having a desired stepped portion.

To form the nozzle 18 and the depression 19 in the nozzle sheet 17 by processing the material of the nozzle sheet 17, isotropic etching may be performed on a silicon (Si) substrate instead of using a laser process. That is, the depression 19 may be formed half way in the nozzle sheet 17 by etching. Subsequently, the nozzle sheet 17 may be drilled until the hole is completely through the nozzle sheet 17. Thus, the nozzle 18 can be formed in the nozzle sheet 17.

Seventh Exemplary Embodiment

Unlike the fourth embodiment in which the nozzle sheet 17 is bonded in a tail-end processing, in a fabrication method according to a seventh embodiment, the ink chambers 12, the nozzle 18, and the depression 19 are integrally formed. That is, the ink chambers 12, the nozzle 18, and the depression 19 are directly formed on the semiconductor substrate 15 having the heating element 13 formed by deposition.

Figure 12:
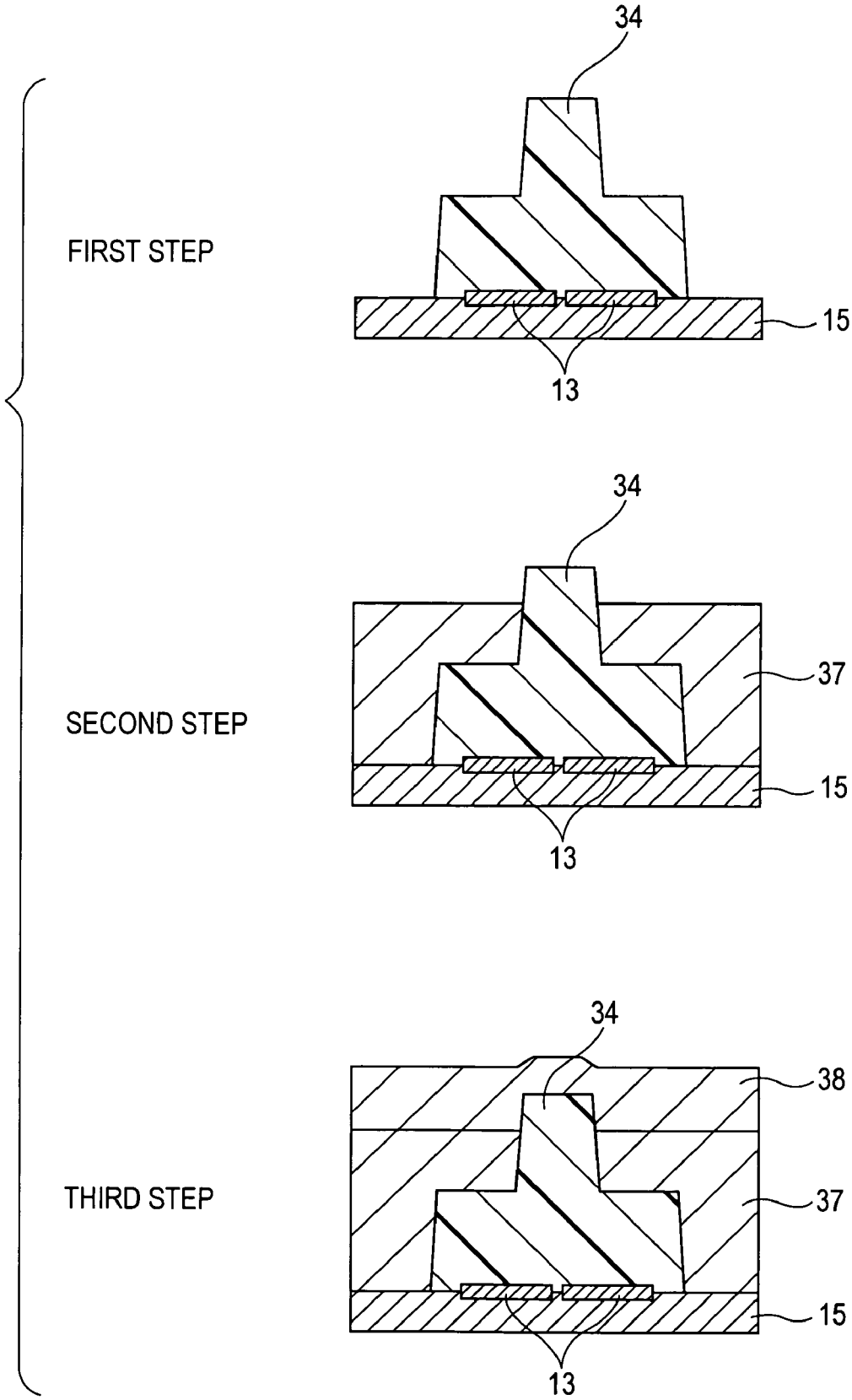
FIG. 12 illustrates a first step to a third step of the fabrication process of a nozzle sheet in the fabrication method of the printer head according to a seventh embodiment.

FIG. 12 illustrates a first step to a third step of the fabrication process of the nozzle sheet 17 in the fabrication method of the printer head 11 according to the seventh embodiment.

Figure 13:
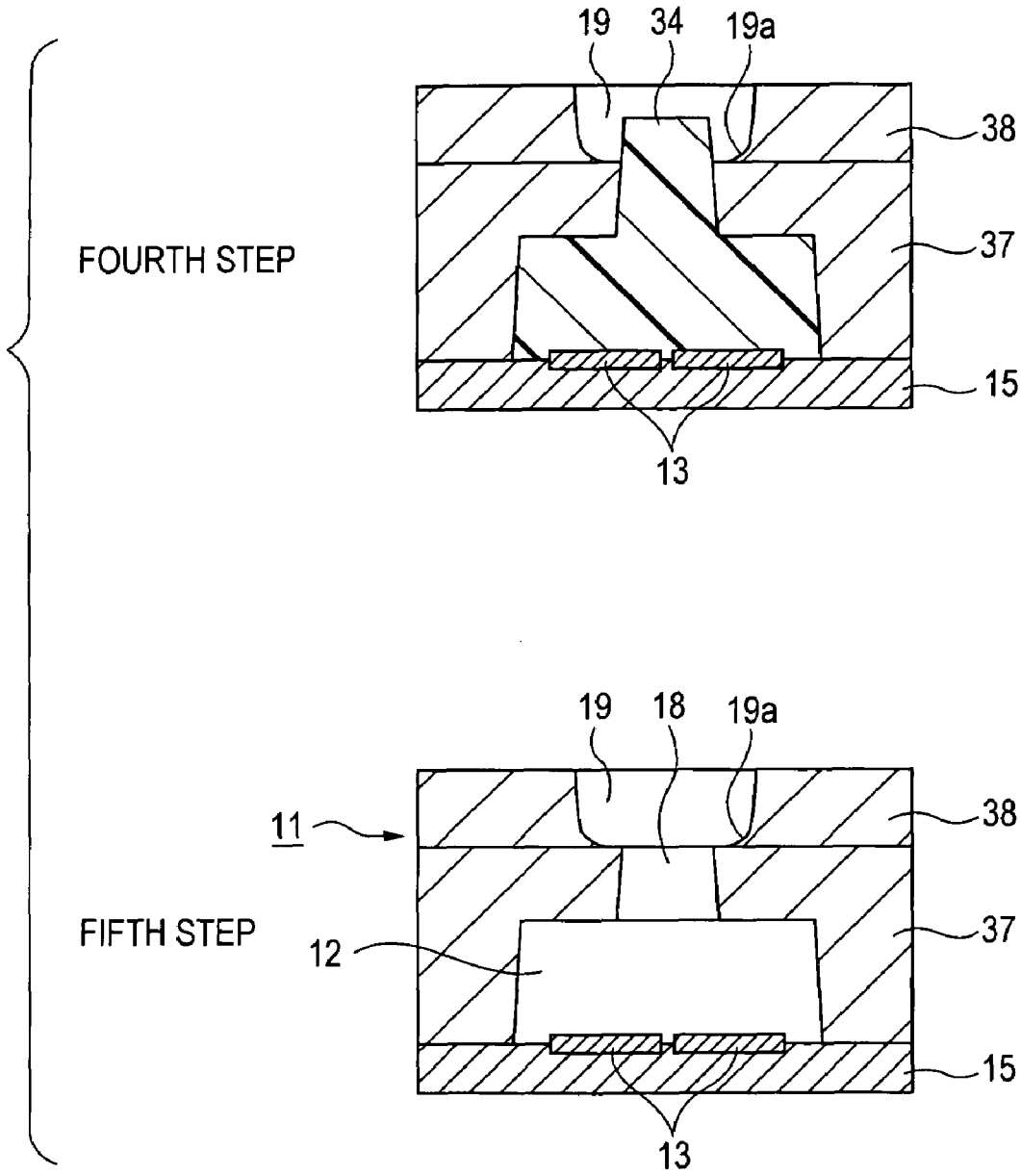
FIG. 13 illustrates a fourth step and a fifth step of the fabrication process of the nozzle sheet in the fabrication method of the printer head according to the seventh embodiment.

FIG. 13 illustrates a fourth step and a fifth step of the fabrication process of the nozzle sheet 17 in the fabrication method of the printer head 11 according to the seventh embodiment.

As shown in FIG. 12, in the first step, a resist pattern 34 corresponding to the ink chambers 12 (see FIG. 2) and the nozzle 18 (see FIG. 2) is formed on the semiconductor substrate 15 having the heating element 13 formed by deposition. To form the resist pattern 34, a resist layer composed of a photosensitive resin is formed on the semiconductor substrate 15 first. Subsequently, areas corresponding to the ink chambers 12 are exposed to exposure light. Thereafter, areas corresponding to the nozzles 18 are exposed to exposure light. Finally, the resist layer is developed. As a result, the protruding resist pattern 34 shown by the first step in FIG. 12 is formed.

In the subsequent second step, a nozzle forming layer 37 is formed with a photosensitive resin on the semiconductor substrate 15 around the resist pattern 34. That is, a negative resist is applied to the semiconductor substrate 15 by using a spin coating method so as to form the nozzle forming layer 37. The nozzle forming layer 37 makes up part of a liquid ejection member. The photosensitive resin may be a resin of any type that is capable of being mixed with a photoinitiator or capable of being cured by itself. Examples of the photosensitive resin include an epoxy resin, an acrylate resin, a novolac resin, and a styrene resin. Additionally, a resin that can be cured by electron beams or radiant rays may be used.

In the subsequent third step, a depression forming layer 38 composed of a photosensitive resin is formed on the nozzle forming layer 37 and the resist pattern 34. The depression forming layer 38 is integrated into the nozzle forming layer 37 so as to serve as a liquid ejection member. That is, as in the second step, a negative resist is applied to the nozzle forming layer 37 and the resist pattern 34 by using a spin coating method to form the depression forming layer 38. Therefore, in the seventh embodiment, since the depression forming layer 38 is integrated into the nozzle forming layer 37 so as to form the liquid ejection member, the nozzle sheet 17 (see FIG. 10) is not independent, although the nozzle sheet 17 is independent in the fourth embodiment.

In the fourth step shown in FIG. 13, the depression forming layer 38 is exposed to exposure light and is developed so as to form the depression 19. That is, defocus exposure is performed to an area for the depression 19, and the exposed area is developed. Since the depression forming layer 38 is a negative resist, a mask that covers only the area for the depression 19 is used during the exposure. At that time, to form a rounded shape of the bottom corner 19*a*, the exposure is performed such that the bottom corner 19*a* is facing away from the focusing surface.

Finally, in the fifth step, the resist pattern 34 is resolved and removed so as to form the ink chambers 12 and the nozzle 18 in the nozzle forming layer 37. As a result, as shown by the fifth step in FIG. 13, the depression forming layer 38 is integrated into the nozzle forming layer 37 on the semiconductor substrate 15 having the heating elements 13 formed by deposition so as to form a liquid ejection member. Thus, the printer head 11 in which the ink chambers 12, the nozzle 18, and the depression 19 are directly formed is fabricated. Additionally, by applying further heat to the depression forming layer 38 to be fluidized, the curvature of the rounded bottom corner 19*a* can be increased.

While embodiments and applications of this invention have been shown and described, it would be apparent to those skilled in the art that many more modifications than mentioned above are possible without departing from the inventive concepts herein. For example, the following modifications are possible:

(1) The printer head 11 according to the above-described embodiments is suitable for an inkjet printer. However, the liquid ejection head is not limited to such an application. For example, in addition to ink, the embodiments of the present invention are applicable to a liquid ejection head that ejects a variety of types of liquid.

(2) Although the printer head 11 according to the above-described embodiments includes two divided portions of the heating element 13, the heating element 13 is not necessarily physically divided into a plurality of portions. That is, one base that can differentiate energy distribution on the bubble generation areas (surface areas) can be applied. For example, a single heating element that does not uniformly heat the bubble generation areas and that can control energy for boiling ink in each area can be applied.

(3) Although the printer head 11 according to the above-described embodiments adopts a thermal method using the heating element 13, a heating element other than the heating element 13 may be used. Additionally, the present invention can be applied to an electrostatic ejection method, in which an ink droplet is ejected by a resilient force of a vibration plate. The resilient force is generated as follows: two electrodes are disposed under the vibration plate with an air layer between the vibration plate and the electrodes; a voltage is applied to the two electrodes so as to bend the vibration plate; and the electrostatic force is then released to return the vibration plate to the original state. Furthermore, the present invention can be applied to a piezoelectric method, in which an ink droplet is ejected by deforming a vibration plate layered on a piezoelectric element having an electrode on either side of the laminate using a piezoelectric effect.

(4) The printer head 11 according to the above-described embodiments can be applied to either a line inkjet printer in which a plurality of heads are arranged in the width direction of a recording medium to form a line head having a print width or a serial inkjet printer in which a head is moved in the width direction of a recording medium so as to perform a print operation.

(5) The printer head 11 according to the above-described embodiments can be applied to either a color inkjet printer or a black-and-white inkjet printer. However, in the case of a color inkjet printer, it is desirable that the printer head 11 includes a mechanism that prevents ink of different colors from mixing with each other.

What is claimed is:

1. A liquid ejection head comprising:

a liquid ejection member;

a nozzle located therein;

a depression formed around the nozzle on a surface of the liquid ejection member;

a liquid chamber associated and in fluid communication with the nozzle and configured to contain liquid; and an energy generating element associated with the liquid chamber and configured to generate energy to eject the liquid contained in the liquid chamber from the nozzle as a liquid droplet;

wherein, the nozzle has an opening with a width D, the distance between the surface of the energy generating element and a liquid droplet ejection surface is H, the ratio D/H is greater than or equal to 0.9 μm and effectively extends the deflection width of the effected ink to a value greater than or equal to 120 μm, an opening of the depression has a width greater than the width D of the opening of the nozzle, and the nozzle is positioned at the bottom of the depression, and the interior angle of the bottom corner of the depression is greater than 90 degrees.

2. The liquid ejection head according to claim 1, wherein the bottom corner of the depression has a curved surface.

3. The liquid ejection head according to claim 1, wherein the bottom corner of the depression has a sloped surface.

4. The liquid ejection head according to claim 1, wherein the surface of the liquid ejection member including the depression is treated with a water-repellent finish.

5. A liquid ejection apparatus including a liquid ejection head said liquid ejection head comprising:

a liquid ejection member;

a nozzle located therein;

a depression formed around the nozzle on a surface of the liquid ejection member;

a liquid chamber associated and in fluid communication with the nozzle and configured to contain liquid;

an energy generating element associated with the liquid chamber and configured to generate energy to eject the liquid contained in the liquid chamber from the nozzle as a liquid droplet element wherein, the liquid droplet is deposited onto a recording medium so as to print an image on the recording medium, the nozzle has an opening with a width D, the distance between the surface of the energy generating element and a liquid droplet ejection surface is H, the ratio D/H is greater than or equal to 0.9 μm and effectively extends the deflection width of the ejected liquid to a value greater than or equal to 120 μm, an opening of the depression has a width greater than the width D of the opening of the nozzle, the nozzle is positioned at the bottom of the depression, and the interior angle of the bottom corner of the depression is greater than 90 degrees, and the overflow liquid is deposited in the interior of the depression is returned to the nozzle after the liquid droplet has been ejected from the nozzle.

6. The liquid ejection apparatus according to claim 5, wherein the liquid in the depression formed on the liquid ejection member of the liquid ejection head is returned to the nozzle by an action of a pressure lower than the atmospheric pressure.

7. The liquid ejection apparatus according to claim 5, wherein an ejection direction of the liquid droplet from the nozzle is deflected by controlling a manner of providing, to the liquid, energy generated by the energy generating element of the liquid ejection head.

* * * * *